US012655595B2

(12) United States Patent
Downey

(10) Patent No.: US 12,655,595 B2
(45) Date of Patent: Jun. 16, 2026

(54) SUPPORTS FOR HELICAL PILES

(71) Applicant: Hubbell Incorporated, Shelton, CT (US)

(72) Inventor: Shawn David Downey, Columbia, MO (US)

(73) Assignee: Hubbell Incorporated, Shelton, CT (US)

( * ) Notice: Subject to any disclaimer, the term of this patent is extended or adjusted under 35 U.S.C. 154(b) by 476 days.

(21) Appl. No.: 18/029,591

(22) PCT Filed: Oct. 12, 2021

(86) PCT No.: PCT/US2021/054463

§ 371 (c)(1),
(2) Date: Mar. 30, 2023

(87) PCT Pub. No.: WO2022/076944

PCT Pub. Date: Apr. 14, 2022

(65) Prior Publication Data

US 2023/0383492 A1 Nov. 30, 2023

Related U.S. Application Data

(60) Provisional application No. 63/089,947, filed on Oct. 9, 2020.

(51) Int. Cl.

| | |
|---|---|
| ***E02D 5/54*** | (2006.01) |
| ***E02D 5/56*** | (2006.01) |
| ***E02D 7/22*** | (2006.01) |

(52) U.S. Cl.

CPC ..... *E02D 5/56* (2013.01); *E02D 5/54* (2013.01); *E02D 7/22* (2013.01)

(58) Field of Classification Search

CPC ..... E02D 5/54; E02D 5/56; E02D 5/52–526; E02D 7/22

See application file for complete search history.

(56) References Cited

U.S. PATENT DOCUMENTS

| | | | |
|---|---|---|---|
| 277,708 | A | 5/1883 | Gorla |
| 287,923 | A | 11/1883 | Gorla |
| 340,292 | A | 4/1886 | Cox |
| 1,964,250 | A | 6/1934 | Countryman |
| 3,312,488 | A | 4/1967 | Lickliter et al. |
| 3,342,444 | A | 9/1967 | Nelson |

(Continued)

FOREIGN PATENT DOCUMENTS

| | | |
|---|---|---|
| EP | 0040326 | 11/1981 |
| WO | 2009130625 | 10/2009 |

OTHER PUBLICATIONS

Introduction to Shaner Industries' Metal Foundation System, 2012 (7 pages).

(Continued)

*Primary Examiner* — Amber R Anderson
*Assistant Examiner* — Stacy N Lawson
(74) *Attorney, Agent, or Firm* — Wissing Miller LLP

(57) ABSTRACT

The present disclosure provides a support member for a shaft of a helical pile, the support member includes a hollow shaft that can receive a shaft of the helical pile and a plurality of fins secured to the hollow shaft and extends from the hollow shaft. The hollow shaft is independently movable relative to the helical pile shaft.

17 Claims, 20 Drawing Sheets

(56) References Cited

U.S. PATENT DOCUMENTS

| | | | | |
|---|---|---|---|---|
| 3,727,357 | A | 4/1973 | Stillman | |
| 3,969,853 | A | 7/1976 | Deike | |
| 4,252,472 | A | 2/1981 | Moraly | |
| 4,530,190 | A | 7/1985 | Goodman | |
| 4,833,846 | A * | 5/1989 | McFeetors | E04H 12/20 52/157 |
| 4,850,565 | A | 7/1989 | Moreno | |
| 4,858,876 | A | 8/1989 | Moreno | |
| 4,882,891 | A | 11/1989 | Sero et al. | |
| 4,974,997 | A | 12/1990 | Sero et al. | |
| 5,148,641 | A | 9/1992 | Rushing et al. | |
| 5,575,122 | A | 11/1996 | Hamilton et al. | |
| 5,607,261 | A | 3/1997 | Odom et al. | |
| 5,647,557 | A | 7/1997 | Faulkner | |
| 6,074,133 | A | 6/2000 | Kelsey | |
| 6,263,622 | B1 | 7/2001 | Griffin et al. | |
| 6,540,196 | B1 | 4/2003 | Ellsworth | |
| 7,165,915 | B2 | 1/2007 | Queen | |
| 7,241,079 | B2 | 7/2007 | Francis | |
| 7,942,612 | B1 * | 5/2011 | Willison | E02D 5/74 52/153 |
| 8,156,695 | B2 | 4/2012 | Smith | |
| 8,888,413 | B2 | 11/2014 | Seider et al. | |
| 9,453,318 | B2 | 9/2016 | Kemp et al. | |
| 9,879,444 | B2 | 1/2018 | Gibbs et al. | |
| 10,030,347 | B2 | 7/2018 | Kemp | |
| 10,508,406 | B1 | 12/2019 | Childress et al. | |
| 10,526,758 | B1 * | 1/2020 | Martin | B60W 60/0015 |
| 10,794,030 | B2 | 10/2020 | Kemp et al. | |
| 2006/0127188 | A1 * | 6/2006 | Francis | E02D 5/56 405/231 |
| 2007/0000187 | A1 | 1/2007 | St. Onge et al. | |
| 2008/0302028 | A1 * | 12/2008 | Lewenhoff | E02D 7/22 52/157 |
| 2009/0293379 | A1 | 12/2009 | Smith | |
| 2010/0257794 | A1 * | 10/2010 | Stark | E02D 5/80 52/165 |
| 2011/0020068 | A1 | 1/2011 | Kelly et al. | |
| 2011/0185649 | A1 | 8/2011 | Lin | |
| 2013/0121772 | A1 | 5/2013 | Karsten | |
| 2014/0020310 | A1 | 1/2014 | Lee | |
| 2014/0079491 | A1 | 3/2014 | Foster et al. | |
| 2016/0186402 | A1 | 6/2016 | Tomchesson et al. | |
| 2016/0186403 | A1 * | 6/2016 | Tomchesson | E02D 5/54 405/252.1 |
| 2016/0215470 | A1 | 7/2016 | Reusing et al. | |
| 2017/0130416 | A1 | 5/2017 | Wilson et al. | |
| 2017/0218590 | A1 | 8/2017 | Raposo et al. | |
| 2021/0238820 | A1 | 8/2021 | Plotkin et al. | |

OTHER PUBLICATIONS

Darin Willis, P.E. and Justin Presley, Helical Piles, RamJack PDHG, Dec. 2019 (4 pages).

International Search Report and Written Opinion mailed on Mar. 1, 2022 in corresponding PCTUS2021054463 (14 pages).

International Preliminary Report on Patentability mailed Apr. 20, 2023 in corresponding PCTUS2021054463 (11 pages).

Office Action in corresponding Mexican Application No. 3,044,662 mailed on Apr. 24, 2024. (26 pages).

* cited by examiner

Fig. 6
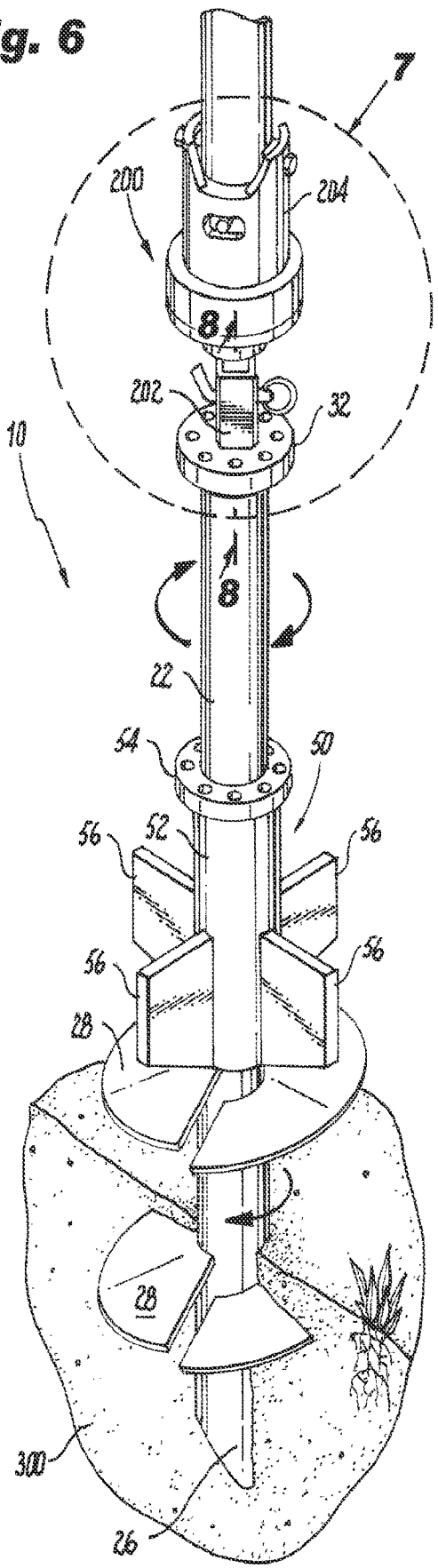
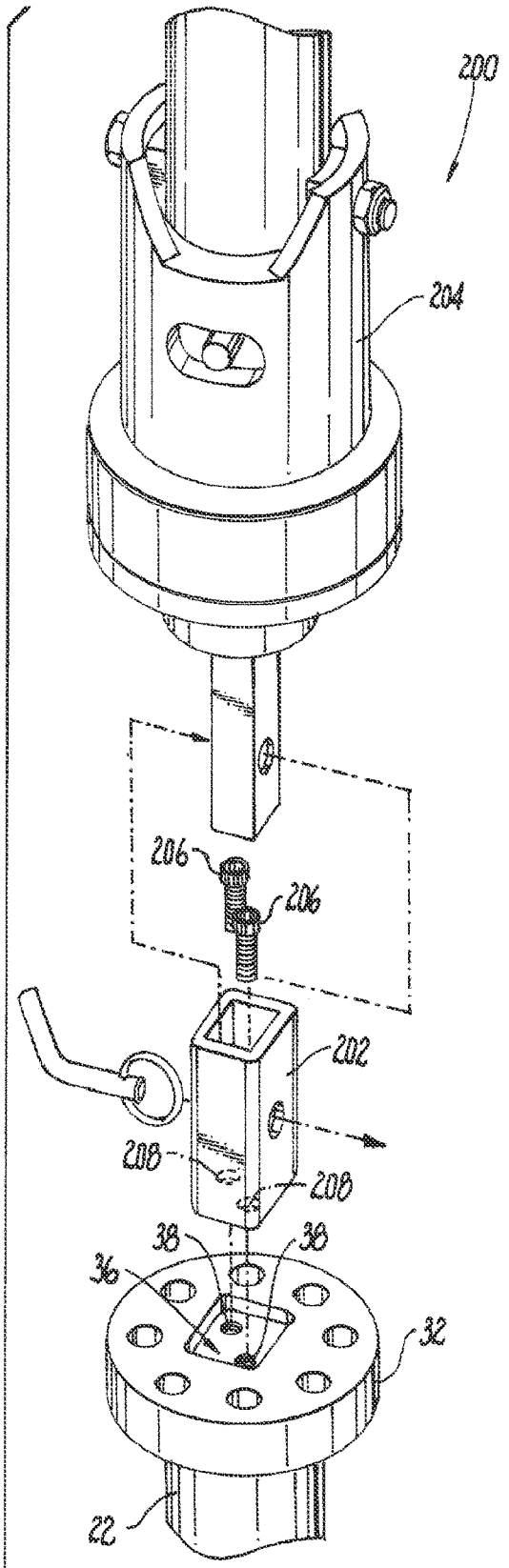
Fig. 7

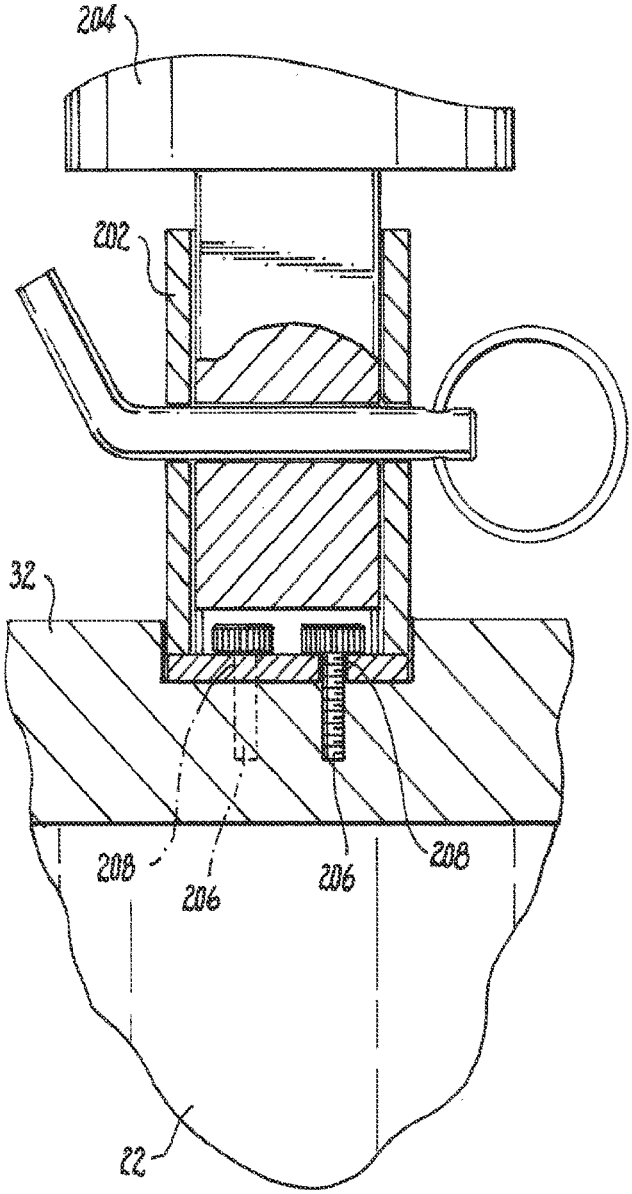
Fig. 8
Fig. 9
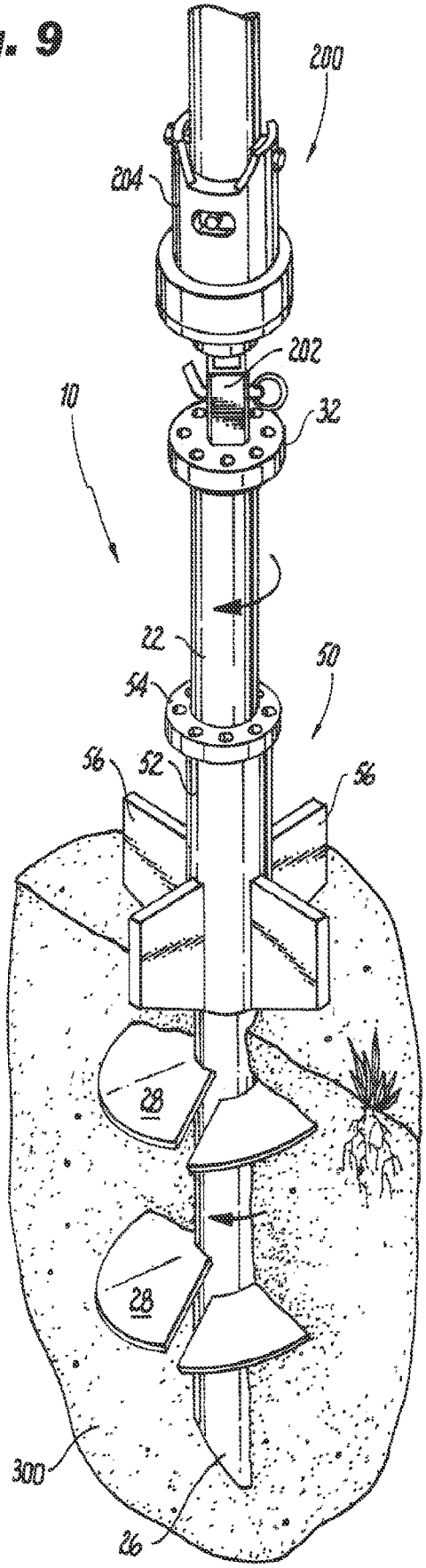

SUPPORTS FOR HELICAL PILES

CROSS-REFERENCE TO RELATED APPLICATIONS

This application is a 371 of PCT/US2021/054463 filed on Oct. 12, 2021, published on Apr. 14, 2022 under publication number WO 2022/076944 A1, which claims priority benefits from U.S. Provisional Patent Application No. 63/089,947, filed Oct. 9, 2020, both of which are incorporated herein in their entirety by reference.

BACKGROUND

Field

The present disclosure relates generally to supports for helical piles and to helical pile assemblies, and more particularly to support members for helical pile assemblies that provide resistance to lateral and torsional loads on the helical piles.

Description of the Related Art

Piles are used to support structures, such as buildings, towers, etc., when the soil underlying the structure would be too weak alone to support the structure. To effectively support a structure, a pile has to penetrate the soil to a depth where competent load-bearing stratum is found. Conventional piles can be cast in place by excavating a hole in the place where the pile is needed, or a hollow form can be driven into the soil where the pile is needed, and then filled with cement. These approaches are cumbersome and expensive.

Helical or screw anchors/piles are a cost-effective alternative to conventional cement piles because of the speed and ease at which a helical pile can be installed. A helical pile is an extendable foundation system having helical bearing plates welded to a central steel or galvanized steel shaft or lead. The load of the structure is transferred from the shaft to the soil through the helical bearing plates. Helical piles are rotated into the soil such that the load bearing helical plates at the lower end of the pile effectively screw the pile into the soil to a desired depth. Depending on the soil conditions, after the pile is installed portions of the steel shafts, particularly portions near the surface stratum and/or other layers, may provide little or no resistance to lateral and/or torsional loads applied by the structure onto the helical pile.

Accordingly, a need exists for a way of improving the resistance to lateral and/or torsional loads for helical piles to minimize and possibly prevent lateral and/or torsional shift of the helical pile once installed.

SUMMARY

The present disclosure provides exemplary embodiments of support members used with helical piles to provide resistance to lateral and torsional loads on the helical piles. The present disclosure also provides exemplary embodiments of helical pile assemblies that may include a lead and a support member, or a lead, an extension and a support member. An exemplary embodiment of a support member according to the present disclosure includes a hollow shaft, a flange and a plurality of fins. The hollow shaft is configured to receive the lead shaft so that the hollow shaft is movable independent of the lead shaft. Preferably, the hollow shaft is rotatable independent of the lead shaft. The flange includes a plurality of mounting apertures around a perimeter thereof and is positioned at one end of the hollow shaft. The flange is used to connect the support member to the lead. The plurality of fins are positioned around a perimeter of the hollow shaft and extend away from the hollow shaft.

Another exemplary embodiment of a support member according to the present disclosure includes a first support member segment and a second support member segment. The first support member segment includes a first hub body and at least one first fin extending away from the first hub body. The second support member segment includes a second hub body and at least one second fin extending away from the second hub body. The second hub body having a top end and a bottom end, wherein the top end of the second hub body includes an attachment member transversely disposed relative to the second hub body. The first support member segment and the second support member segment are configured to removably mate such that the first hub body and the second hub body form a hollow shaft. The hollow shaft is configured to receive the lead shaft or the extension shaft so that the hollow shaft is movable independent of the lead shaft or the extension shaft.

An exemplary embodiment of a helical pile assembly includes a lead and a support member. The lead includes a lead shaft having a head portion and an end portion, an attachment member secured to the head portion of the lead shaft, and at least one helical plate secured to the end portion of the lead shaft. The support member is positioned on the lead shaft between the lead plate and the at least one helical plate. The support member includes a hollow shaft, a support member flange and a plurality of fins. The hollow shaft is configured to receive the lead shaft so that the lead shaft is movable independent of the hollow shaft. The support member flange is positioned at one end of the hollow shaft. The plurality of fins are positioned around a perimeter of the hollow shaft and extend away from the hollow shaft.

Another exemplary embodiment of a helical pile assembly includes a lead, one or more extensions and a support member. The lead includes a lead shaft that has a head portion and an end portion, and at least one helical plate secured to the end portion of the lead shaft. The extension includes an extension shaft and an attachment member. The extension shaft has a head portion and an end portion. The end portion of the extension shaft is configured to couple to the head portion of the lead shaft. The attachment member is secured to the head portion of the extension shaft. The support member is positioned on the extension shaft between the attachment member and the end portion of the extension shaft. The support member includes a hollow shaft, a support member and a plurality of fins. The hollow shaft is configured to receive the extension shaft so that the hollow shaft is movable independent of the extension shaft. The support member flange is positioned at one end of the hollow shaft. The plurality of fins are positioned around a perimeter of the hollow shaft and extend away from the hollow shaft.

Another exemplary embodiment of a helical pile assembly includes a lead, an extension and a support member. The lead includes a lead shaft having a head portion and an end portion and at least one helical plate secured to the end portion of the lead shaft. The extension includes an extension shaft and a first attachment member. The extension shaft has a head portion and an end portion that is configured to couple to the head portion of the lead shaft. The first attachment member is secured to the head portion of the extension shaft. The support member is positioned on the extension shaft between the first attachment member and the end portion of the extension shaft. The support member includes a first support member segment removably mated with a second support member segment to form a hollow shaft configured to receive the extension shaft such that the hollow shaft of the support member is movable independent of the extension shaft. The first support member segment includes at least one first fin extending away from the hollow shaft. The second support member segment includes a top end, a bottom end, and at least one second fin extending away from the hollow shaft. The top end of the second support member segment includes a second attachment member transversely disposed relative to the hollow shaft.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein:

FIG. 6 is a side perspective view of the helical pile assembly of FIG. 1 being inserted into the soil, illustrating a drive head and drive wrench of a drive system attached to an attachment member at a head portion of the lead shaft and rotating the lead shaft to drive the lead shaft into the soil;

FIG. 7 is an enlarged perspective view of the head portion of the lead shaft, and drive wrench and drive head of FIG. 6 taken from detail 7;

FIG. 8 is an enlarged cross-sectional view of the head portion of the lead shaft connected to the drive wrench of FIG. 6 taken from line 8-8;

FIG. 9 is a side perspective view of the of the helical pile assembly, drive head and drive wrench of FIG. 6, illustrating the lead shaft rotating within a shaft of the support member as the lead shaft is being driven into the soil;

DETAILED DESCRIPTION

The following exemplary embodiments are set forth to aid in an understanding of the subject matter of this disclosure, but are not intended, and may not be construed, to limit in any way the claims which follow thereafter. Therefore, while specific terminology is employed for the sake of clarity in describing some exemplary embodiments, the present disclosure is not intended to be limited to the specific terminology so selected, and it is to be understood that each specific element includes all technical equivalents which operate in a similar manner.

The present disclosure provides exemplary embodiments of support members used with helical piles to provide resistance to lateral and torsional loads on the helical piles. The present disclosure also provides exemplary embodiments of helical pile assemblies that may include a lead and a support member, or a lead, one or more extensions and a support member. For ease of description, the helical pile assemblies may also be referred to herein as the "piles" in the plural and the "pile" in the singular.

Figure 1:
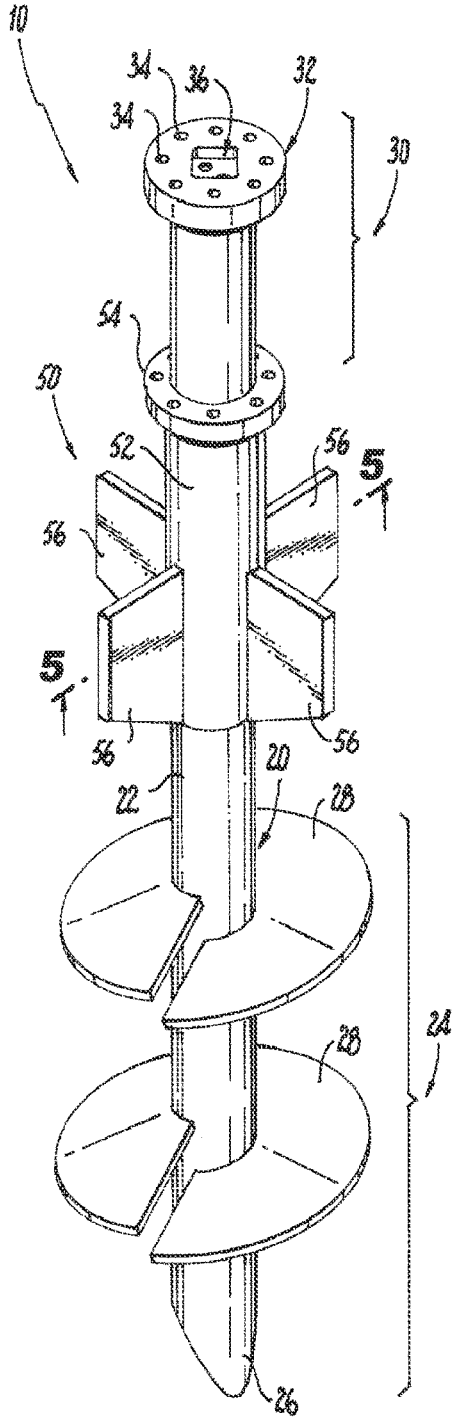
FIG. 1 is a side perspective view of an exemplary embodiment of a helical pile assembly according to the present disclosure, illustrating a lead and a support member.
Figure 2:
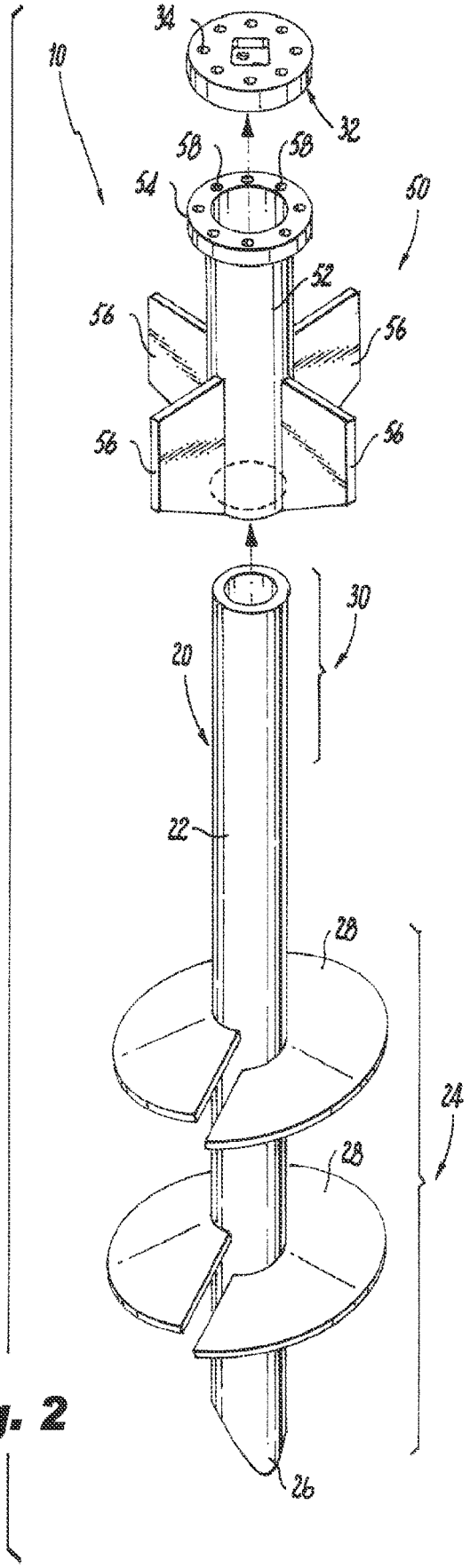
FIG. 2 is an exploded perspective view of the helical pile assembly of FIG. 1, illustrating a shaft of the helical pile lead and the support member coupled to the shaft as a free floating member.

Referring to FIGS. 1 and 2, an exemplary embodiment of a pile according to the present disclosure is shown. In this exemplary embodiment, the pile 10 includes a lead 20 and a support member 50. The lead 20 includes a lead shaft 22 that is preferably circular in cross-section. However, in other exemplary embodiments the lead shaft 22 may have other cross-sectional shapes, such as square, rectangular, pentagonal or hexagonal. The length of the lead shaft 22 may range from, for example, about 3 feet to about 10 feet. The diameter or width of the shaft 22 may range from, for example, about 1 inch to about 7 inches. The lead shaft 22 may be fabricated from steel or galvanized steel and may be hollow or solid. For hollow shafts 22, the thickness of the wall of the shaft may range from, for example, about 0.2 of an inch to about 0.4 of an inch. It is noted that the dimensions of the lead shaft 22 for a particular installation would depend upon the load the pile 10 is to carry, the soil conditions and the type of equipment used for installation.

The lead shaft 22 has an end portion 24 that may include a pointed tip 26 and one or more load bearing helical plates 28 secured thereto that when rotated screw or drive the pile 10 into the soil with minimal disruption to the surrounding soil. For ease of description, the load bearing helical plates may also be referred to herein as the "helical plates" in the plural or the "helical plate" in the singular. The diameter of the helical plates 28 may range from, for example, about 6 inches to about 48 inches. In the event there are multiple helical plates 28 attached to the lead shaft 22, the helical plates 28 may have the same outer diameter, or the helical plates 28 may have different outer diameters that are, for example, in a tapered arrangement. For example, the tapered arrangement may be such that the smallest outer diameter helical plate 28 is closest to the lead tip 26 and the largest helical plate is at a distance away from the lead tip 26. If multiple helical plates 28 are employed, the helical plates on the lead shaft 22 would be spaced apart at a predefined distance that is sufficient to promote individual plate load bearing capacity. In other words, the helical plates 28 are spaced apart such that the helical plates behave or act as individual load bearing elements without interference or influence from adjacent helical plates 28. To accomplish this independent performance, a helical plate 28 is located at a specific distance from adjacent helical plates 28. Preferably, a helical plate 28 is located a predefined multiple of the diameter of the lower helical plate 28 to an adjacent helical plate above it. For example, a predefined distance between the helical plates 28 may be a multiple, e.g., three times, of the diameter of the lowest helical plate 28. Thus, if the outer diameter of the lowest helical plate 28 is 10 inches, the distance to the next helical plate 28 would be three times that 10 inch diameter, which in this example is 30 inches. The helical plates 28 may be fabricated from steel or galvanized steel, and may be welded to or otherwise attached to the lead shaft 22.

In the exemplary embodiment shown in FIGS. 1 and 2, the lead shaft 22 also includes a head portion 30 that includes an attachment member 32 secured to the proximal end of the lead shaft by, for example, a weld joint. The attachment member 32 is configured to couple the head portion 30 to a drive system 200, a portion of which is shown in FIGS. 7 and 8. The attachment member 32 may be fabricated from steel or galvanized steel. In the embodiment shown, the attachment member 32 is a plate. The attachment member 32 includes a plurality of mounting apertures 34 positioned around a perimeter of the attachment member. The mounting apertures 34 can be used to connect the lead shaft 22 to the support member 50, as described below, and possibly to connect the lead shaft 22 to a drive system, e.g., drive system 200, a portion of which is shown in FIGS. 7 and 8. One exemplary embodiment of a system to connect the lead shaft 22 to a drive system 200 is shown in FIGS. 7 and 8. In this exemplary embodiment, the attachment member 32 may also include a cavity 36 preferably in the center of the attachment member 32. The cavity 36 is provided to act as a socket to receive a drive wrench 202 of the drive system 200 so that as the drive wrench 202 is rotated, the attachment member 32 and thus the lead shaft 22 is rotated. The cavity 36 may come in different shapes, such as a square shape, a rectangular shape, a pentagonal shape, or a hexagonal shape. To ensure the drive wrench 202 is secured to the attachment member 32, the cavity 36 may include one or more threaded apertures 38 that receive bolts 206 that are passed through apertures 208 in the drive wrench 202 as shown.

Figure 3:
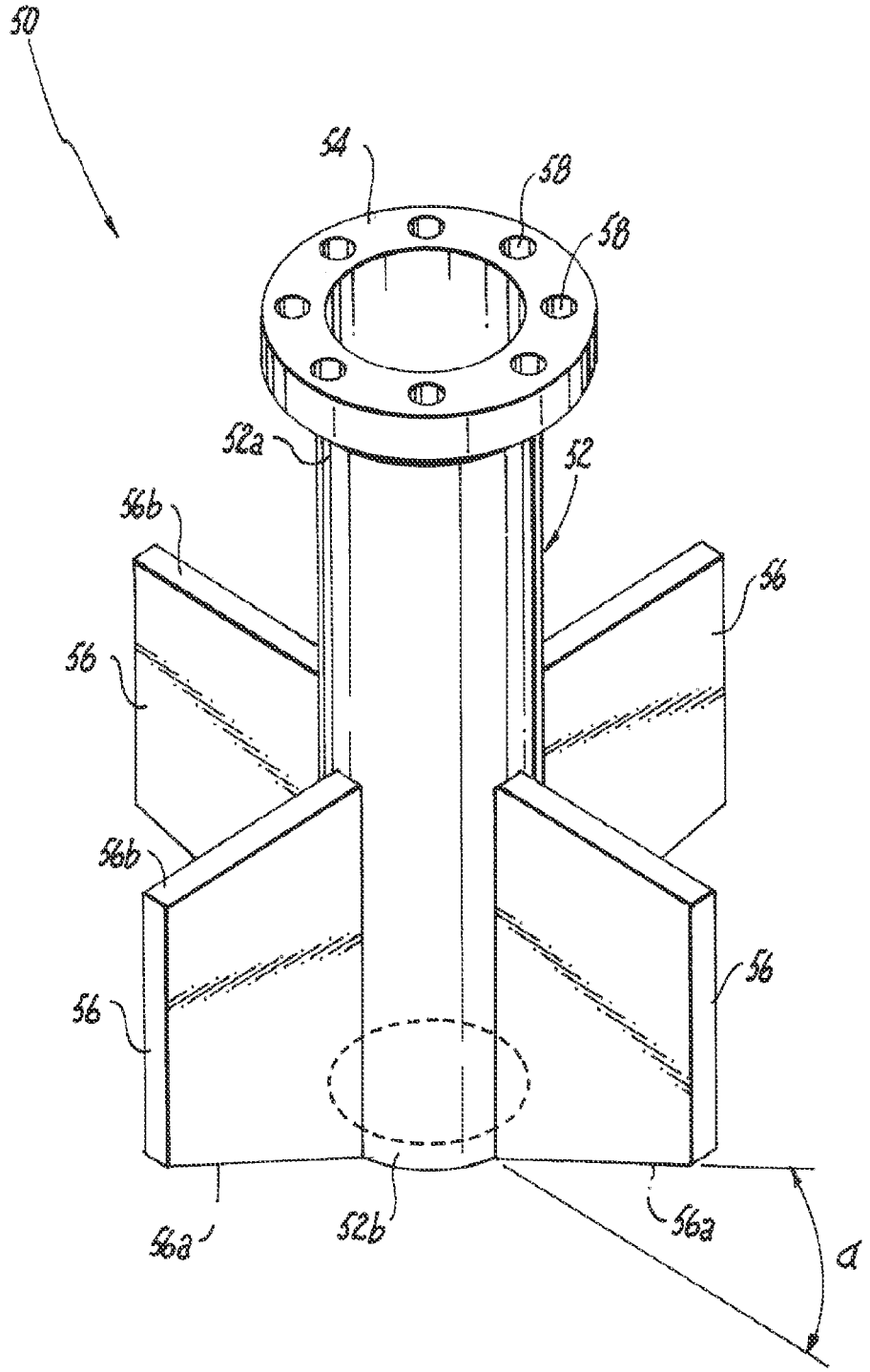
FIG. 3 is a side perspective view of an exemplary embodiment of a support member according to the present disclosure, illustrating a support member shaft, a flange and a plurality of fins.
Figure 4:
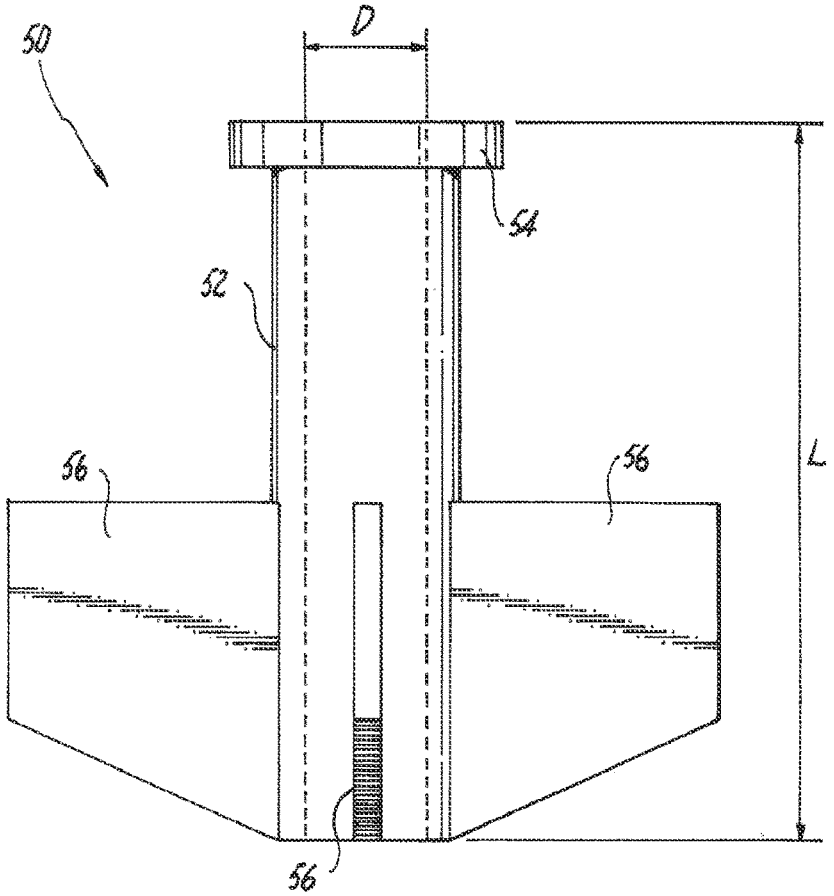
FIG. 4 is a side elevation of the support member of FIG. 3.
Figure 5:
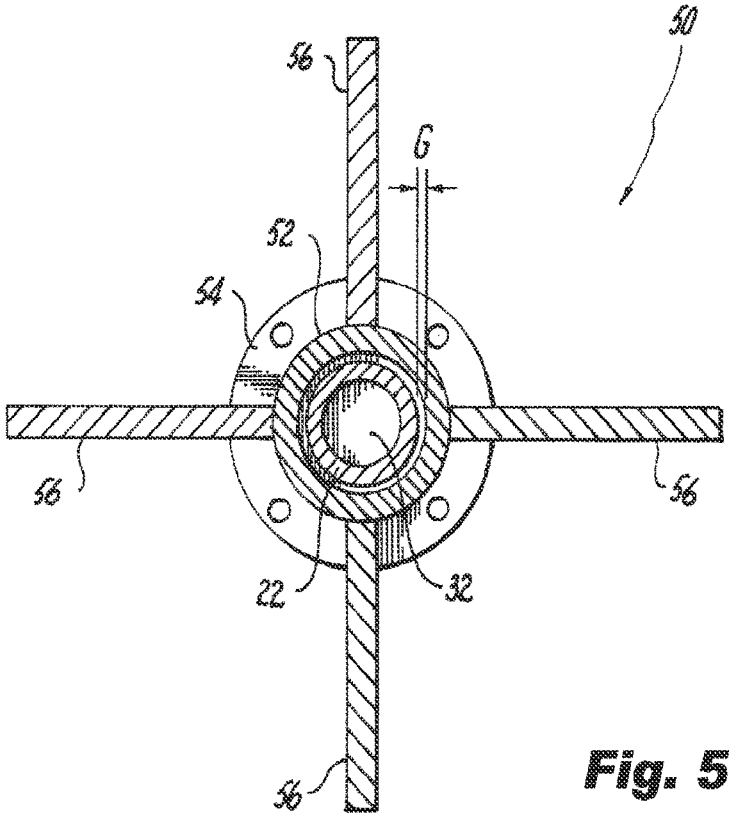
FIG. 5 is a cross-sectional view of the lead shaft and support member of FIG. 1 taken along line 5-5, illustration a gap between the lead shaft and the support member shaft so that the support member is free floating relative to the lead shaft.

Referring to FIGS. 3-5, an exemplary embodiment of a support member 50 according to the present disclosure is shown. The support member 50 includes a support member shaft 52, a flange 54 and one or more fins 56. The support member shaft 52 is a hollow shaft with an inner diameter "D" that is larger than and outer diameter (or width) of the lead shaft 22 so that the support member shaft 52 can receive the lead shaft 22 and move independent of the lead shaft. For example, the support member shaft 52 can rotate and move longitudinally independent of the lead shaft 22. As a non-limiting example, the inner diameter "D" of the support member shaft 52 can be in the range of, for example, about 1 inch and about 8 inches. By having the support member shaft 52 independent of the lead shaft 22, as the lead shaft 22 is rotated to screw or drive the lead 20 into the soil, the lead shaft 22 can freely rotate relative to the support member shaft 52 so that the one or more fins 54 do not rotate and thus do not disturb the soil.

The support member shaft 52 is preferably circular in cross-section such that the support member shaft 52 is tubular. However, in other exemplary embodiments the support member shaft 52 may have other cross-sectional shapes, such as square, rectangular, pentagonal or hexagonal. The length "L" of the support member shaft 52 may range from, for example, about 1 foot to about 5 feet. The diameter or width of the support member shaft 52 is greater than a diameter or width of the lead shaft 22 so that there is a gap "G" between the support member shaft 52 and the lead shaft 22, as shown in FIG. 5. In the exemplary embodiment of FIGS. 3-5, the gap "G" is sufficient to permit the support member shaft 52 to be free floating relative to the lead shaft 22. As a non-limiting example, the diameter or width of the support member shaft 52 may be in the range from, for example, about 1 inch to about 8 inches. The support member shaft 52 may be fabricated from steel or galvanized steel. The thickness of the wall of the support member shaft 52 may be in the range of, for example, about 0.2 of an inch to about 0.5 of an inch. However, it is noted that the dimensions of the support member shaft 52 for a particular installation would depend upon the lateral and torsional loads the pile is to withstand, the soil conditions and the type of equipment used for installation.

Figure 12:
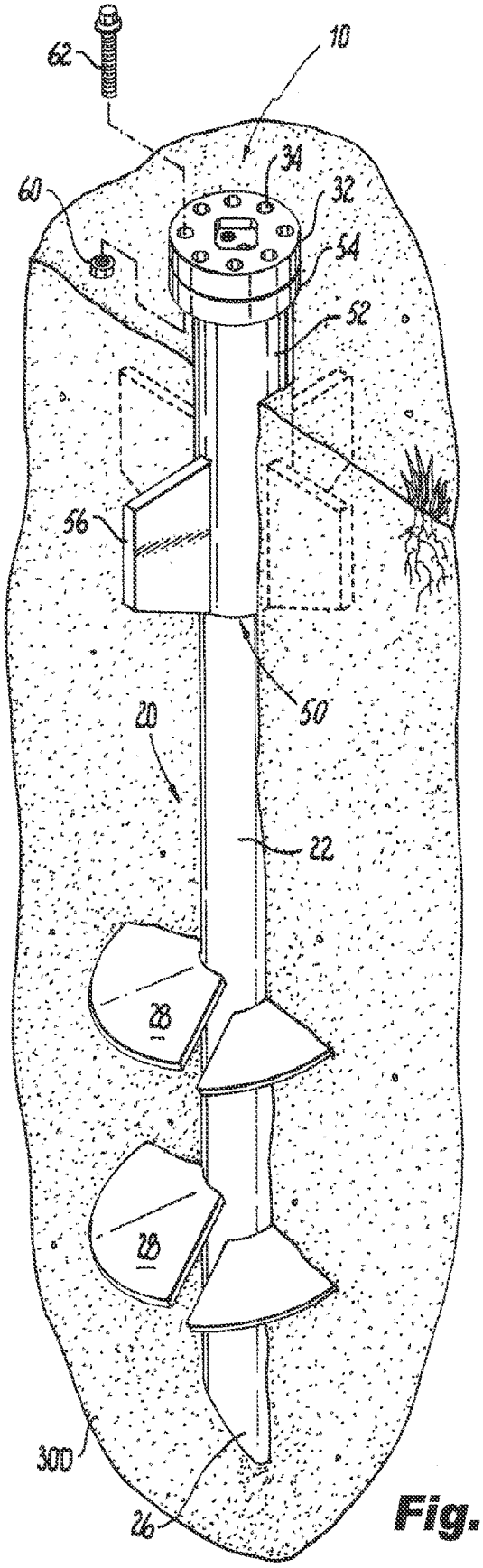
FIG. 12 is a side perspective view of the of the helical pile assembly, drive head and drive wrench of FIG. 11, illustrating the flange of the support member contacting the attachment member of the lead shaft and fins of the support member pulled into the soil after the lead shaft has been driven into the soil.
Figure 13:
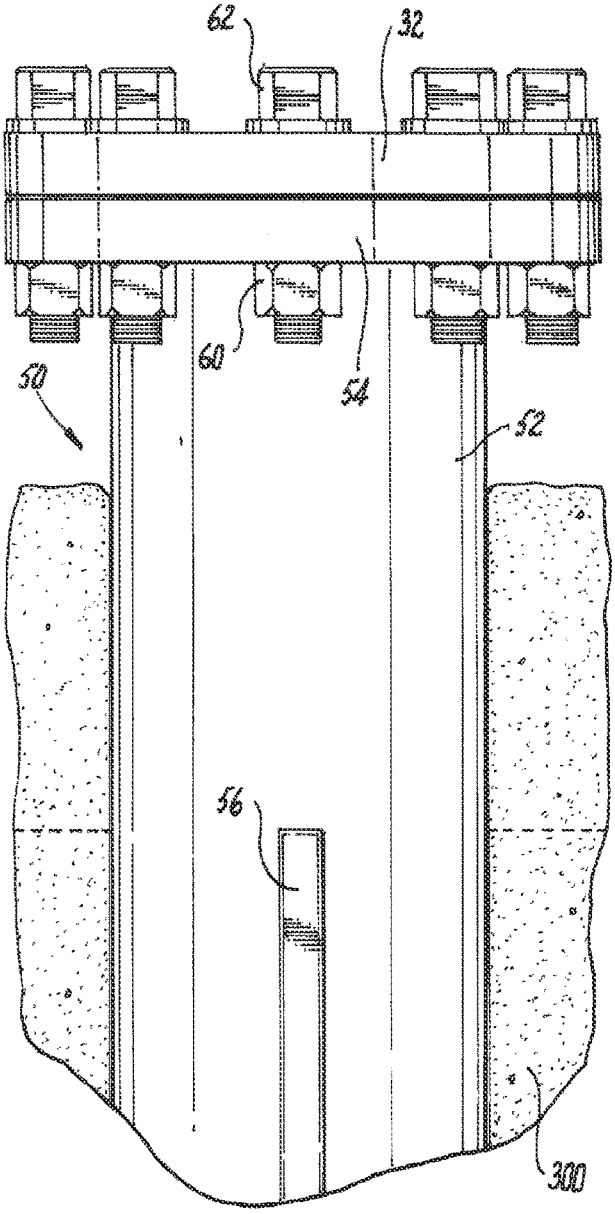
FIG. 13 is a side elevation view of a flange of the support member secured to the attachment member positioned at the head portion of the lead shaft to secure the support member to the lead.

Continuing to refer to FIGS. 3-5, as mentioned above, the support member 50 includes the flange 54 and the one or more fins 56. The flange 54 is a circular or ring like member secured to a first end 52*a* of the support member shaft 52. The flange 54 includes one or more mounting apertures 58 around a perimeter of the flange 54. The one or more mounting apertures 58 can be used to attach the support member 50 to the lead shaft 22 after the lead shaft is driven into the soil. More specifically, the one or more mounting apertures 58 are positioned around a perimeter of the flange 54 and can be aligned with the mounting apertures 34 in the attachment member 32 so that the flange 54 can be secured to the attachment member 32 using for example nuts 60 and bolts 62, seen in FIGS. 12 and 13.

In the exemplary embodiment shown, the one or more fins 56 are spaced around the perimeter of the support member shaft 52 at or near a second end 52*b* of the support member shaft 52. The fins 56 provide resistance to lateral and torsional loads on the piles 10. However, the one or more fins 56 can be positioned at any location along the support member shaft 56. In the exemplary embodiment shown, there four fins 56 spaced apart at 90 degree intervals around the support member shaft 52 so that a bottom edge 56*a* of each fin 56 is positioned at the second end 52*b* of the support member shaft 52. However, there may be more than four fins 56 or less than four fins spaced around the perimeter of the support member shaft 52. Each fin 56 may have the same shape or they may have different shapes. For example, each fin 56 may have a substantially square shape with a flat bottom edge 56*a* and a flat top edge 56*b*. The dimensions of the square shaped fin 56 may be in the range of, for example, about 6 inches by about 24 inches. The dimensions of each fin 56 for a particular installation would depend upon the lateral and torsional loads the pile is to withstand, the soil conditions and the type of equipment used for installation. Preferably, the bottom edge 56*a* of each fin 56 is tapered to facilitate easier insertion of the fin 56 into the soil. The angle "a" of the taper may range from, for example, about 0 degrees and about 45 degrees.

Figure 10:
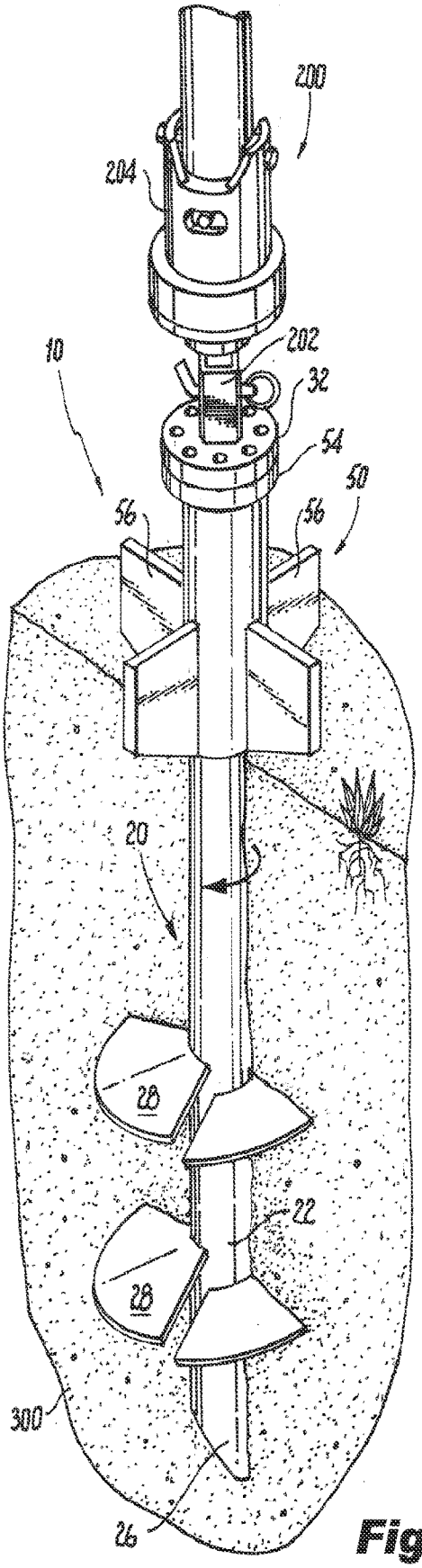
FIG. 10 is a side perspective view of the of the helical pile assembly, drive head and drive wrench of FIG. 9, illustrating the lead shaft rotating within the shaft of the support member as the lead shaft is being driven into the soil.
Figure 11:
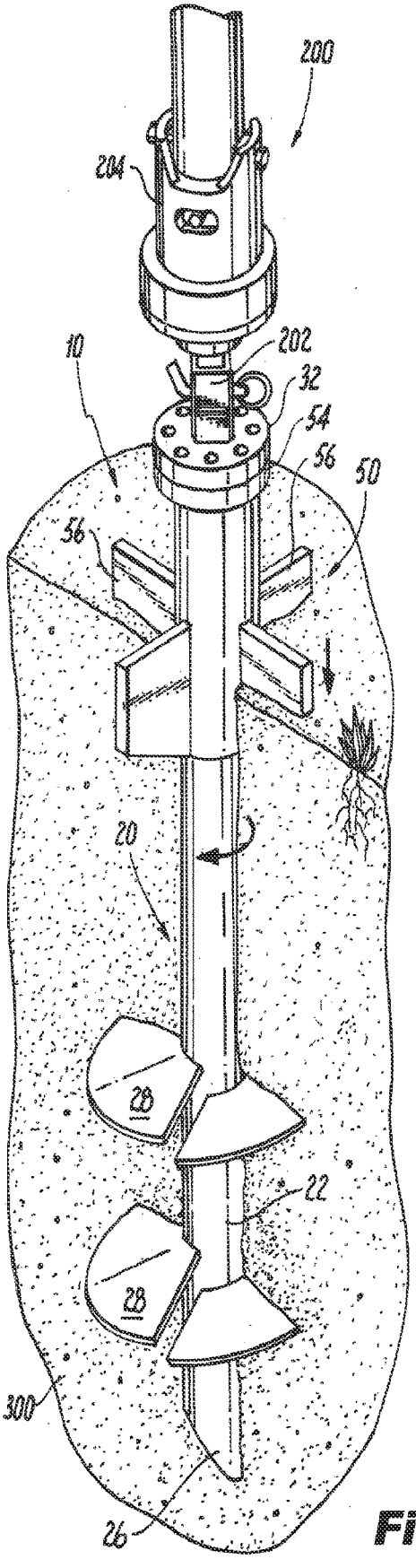
FIG. 11 is a side perspective view of the of the helical pile assembly, drive head and drive wrench of FIG. 10, illustrating a flange of the support member contacting the attachment member of the lead shaft and pulling fins of the support member into the soil as the lead shaft is being driven into the soil.

Turning now to FIGS. 6-13, the installation of the lead 20 and the support member 50 into the soil will be described. After the drive system 200, e.g., the drive wrench 202 and drive head 204, is attached to the attachment member 32 of the lead shaft 22, the lead shaft 22 is rotated by the drive system so that the helical plates 28 screw the lead 20 into the soil with minimal disruption to the surrounding soil. As the lead shaft 22 rotates, the support member 50 does not rotate due to the independent relationship between the lead shaft 22 and the support member shaft 52 described above. As the lead shaft 22 continues to be driven into the soil, the fins 56 of the support member 50 contact the soil, as seen in FIG. 9. As the lead shaft 22 continues to be driven into the soil, the lead 20 continues to move into the soil as the support member 50 remains touching the soil without rotating and disturbing the soil. When the attachment member 32 of the lead 20 contacts the flange 54 of the support member 50, the lead 20, which is still being driven into the soil, pulls the support member shaft 52 and the fins 56 into the soil without rotating and disturbing the soil, as seen in FIGS. 10 and 11. Once the fins 56 are pulled into the soil to a desired depth, the drive system 200 is stopped and detached from the attachment member 32 of the lead 20. The attachment member 32 of the lead 20 is then secured to the flange 54 of the support member 50 using the nuts 60 and the bolts 62, seen in FIGS. 12 and 13. This attachment connects the lead 20 to the support member 50 so that as the structure supported by the pile 10 moves laterally and/or rotates, the fins 56 on the support member 50 will resist such lateral and/or rotational movement of the lead 20.

Figure 14:
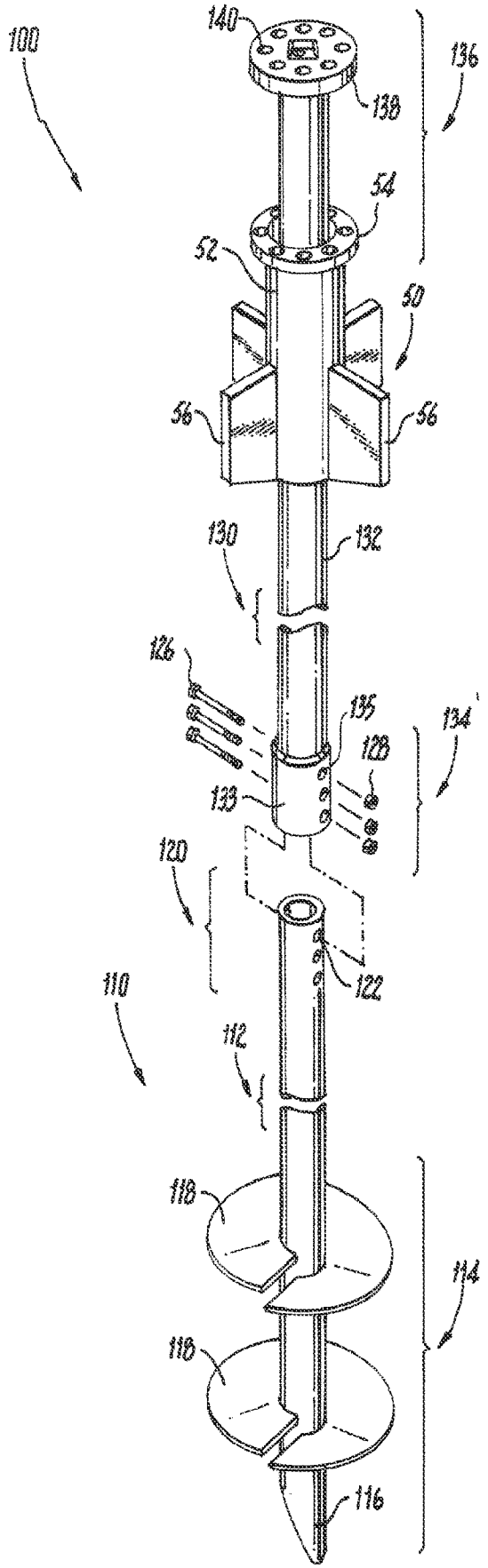
FIG. 14 is an exploded side perspective view of another exemplary embodiment of a helical pile assembly according to the present disclosure, illustrating a lead, an extension inserted into a shaft of a support member.
Figure 15:
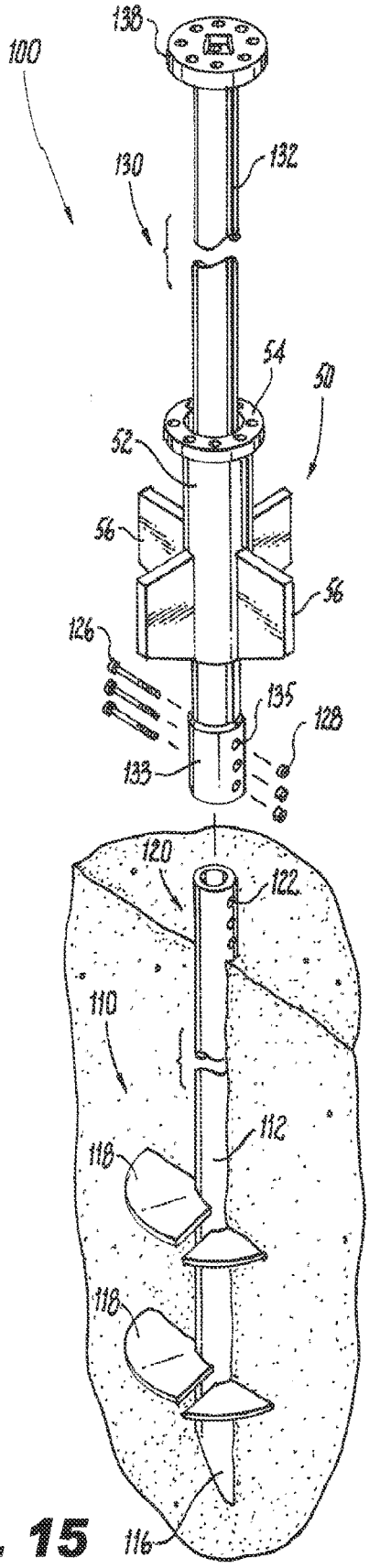
FIG. 15 is a side perspective view of the helical pile assembly of FIG. 14, illustrating the lead inserted into the soil and the extension and support member positioned to be connected to the head portion of the lead.
Figure 16:
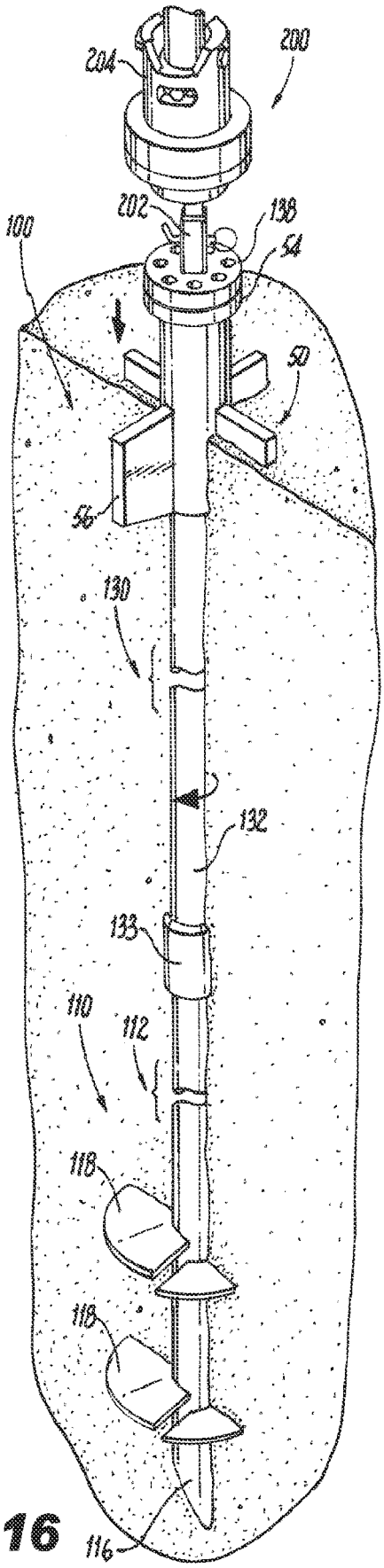
FIG. 16 is a side perspective view of the helical pile assembly of FIG. 15, illustrating the lead and extension being driven into the soil and pulling the fins of the support member into the soil.

As mentioned above, the present disclosure also provides exemplary embodiments of piles 100 that may include a lead 110, one or more extensions 130 and a support member 50. For ease of description, a more detailed description of the support member 50 is not repeated. However, it is noted that in the exemplary embodiments where one or more extensions are included in the piles 100, the diameter or width of the support member shaft 52 is greater than a diameter or width of the lead shaft 22 so that the gap "G" between the support member shaft 52 and the lead shaft 22, shown in FIG. 5, is sufficient to permit the support member shaft 52 to be free floating relative to the lead shaft 22 and to permit the support member shaft 52 to pass over an end portion of the extension shaft. An exemplary embodiment of such a pile 100 is shown in FIGS. 14-16. In this exemplary embodiment, the lead 110 includes a lead shaft 112 that is preferably circular in cross-section. However, in other exemplary embodiments the lead shaft 112 may have other cross-sectional shapes, such as square, rectangular, pentagonal or hexagonal. The length of the lead shaft 112 may range from, for example, about 3 feet to about 10 feet. The diameter or width of the shaft 112 may range from, for example, about 1 inch to about 7 inches. The lead shaft 112 may be fabricated from steel or galvanized steel and may be hollow or solid. For hollow lead shafts 112, the thickness of the wall of the lead shaft 112 may range from, for example, about 0.2 of an inch to about 0.4 of an inch. It is noted that the dimensions of the lead shaft 112 for a particular installation would depend upon the load the pile 100 is to carry, the soil conditions and the type of equipment used for installation.

The lead shaft 112 has an end portion 114 that may include a pointed tip 116 and one or more load bearing helical plates 118 secured thereto that when rotated screw the pile 100 into the soil with minimal disruption to the surrounding soil. The diameter of the helical plates 118 may range from, for example, about 6 inches to about 48 inches. In the event there are multiple helical plates 118 attached to the lead shaft 112, the helical plates 118 may have the same outer diameter, or the helical plates 118 may have different outer diameters that are, for example, in a tapered arrangement. For example, the tapered arrangement may be such that the smallest outer diameter helical plate 118 is closest to the lead tip 116 and the largest helical plate is at a distance away from the lead tip 116. If multiple helical plates 118 are employed, the helical plates on the lead shaft 112 would be spaced apart at a predefined distance that is sufficient to promote individual plate load bearing capacity. In other words, the helical plates 118 are spaced apart such that these helical plates will behave or act as individual load bearing elements without interference or influence from adjacent helical plates 118. To accomplish this independent performance, a helical plate 118 is located at a specific distance from adjacent helical plates 118. Preferably, a helical plate 118 is located a predefined multiple of the diameter of the lower helical plate 118 to an adjacent helical plate above it. For example, a predefined distance between the helical plates 118 may be a multiple, e.g., three times, of the diameter of the lowest helical plate 118. Thus, if the outer diameter of the lowest helical plate 118 is 10 inches, the distance to the next helical plate 118 would be three times that 10 inch diameter. The helical plates 118 may be fabricated from steel or galvanized steel and may be welded to or otherwise attached to the lead shaft 112.

In the exemplary embodiment shown in FIGS. 14-16, the lead shaft 112 also includes a head portion 120 configured to connect to an extension, such as extension 130. Typically, the lead head portion 120 is connected to an extension using one or more fasteners, such as bolts 126 and corresponding nuts 128, and preferably using galvanized nuts and bolts. In the embodiment shown, the lead head portion 120 is configured to be receive by an end portion of the extension 130 and includes one or more connection apertures 122. The one or more connection apertures 122 are configured and dimensioned to receive the bolts 126.

The extension 130 includes an extension shaft 132 having an extension end portion 134 and an extension head portion 136. In this exemplary embodiment, the extension shaft 132 is preferably circular in cross-section. However, in other exemplary embodiments the extension shaft 132 may have other cross-sectional shapes, such as square, rectangular, pentagonal or hexagonal. The length of the extension shaft 132 may range from, for example, about 3 feet to about 10 feet. The diameter or width of the extension shaft 132 may range from, for example, about 1 inch to about 7 inches. The extension shaft 132 may be fabricated from steel or galvanized steel and may be hollow or solid. For hollow extension shafts 132, the thickness of the wall of the shaft may range from, for example, about 0.2 of an inch to about 0.4 of an inch. It is noted that the dimensions of the extension shaft 132 for a particular installation would depend upon the load the pile 100 is to carry, the soil conditions and the type of equipment used for installation.

The extension end portion 134 includes a coupler 133, e.g., a female coupler, that is configured and dimensioned to receive the lead head portion 120. The coupler 133 includes one or more connection apertures 135 therethrough that are capable of receiving the bolt 126. The one or more connection apertures 135 in the female coupler 133 are configured and positioned to align with the one or more connection apertures 122 in the lead head portion 120. In this configuration, the extension end portion 134 can be secured to the lead head portion 120 using the bolt 126 that is passed through the apertures 135 and 122, and the nut 128 is secured to the bolt.

In this exemplary embodiment, the extension head portion 136 includes an extension attachment member 138. The attachment member 138 is configured to couple the head portion 136 of the extension 130 to the drive system 200, a portion of which is shown in FIG. 16. The attachment member 138 may be fabricated from steel or galvanized steel. In the embodiment shown, the attachment member 138 is a plate. The extension attachment member 138 includes a plurality of mounting apertures 140 positioned around a perimeter of the extension plate 138. The mounting apertures 140 can be used to connect the extension shaft 112 to the support member 50, and possibly to connect the extension shaft 112 to a drive system, e.g., drive system 200 a portion of which is shown in FIG. 16. One exemplary embodiment of a connection system to connect the extension shaft 132 to a drive system 200 is similar to the cavity 36 in the attachment member 32, shown in FIGS. 7 and 8, and the one or more threaded apertures 38 that receive bolts 206 that are passed through apertures 208 in the drive wrench 202. For ease of description, a detailed description of the connection system is not repeated.

As mentioned above, the present disclosure also provides exemplary embodiments of piles 150 that may include the lead 110, one or more extensions 160, a drive tool 180 and a support member 50. The lead 110 and support member 50 are described hereinabove and for ease of description are not repeated. However, it is noted that in the exemplary embodiments where one or more extensions are included in the piles 150, the diameter or width of the support member shaft 52 is greater than a diameter or width of the lead shaft 22 so that the gap "G" between the support member shaft 52 and the lead shaft 22, shown in FIG. 5, is sufficient to permit the support member shaft 52 to be free floating relative to the lead shaft 22 and to permit the support member shaft 52 to pass over an end portion of the extension shafts. An exemplary embodiment of such a pile 150 is shown in FIGS. 17-19.

Figure 17:
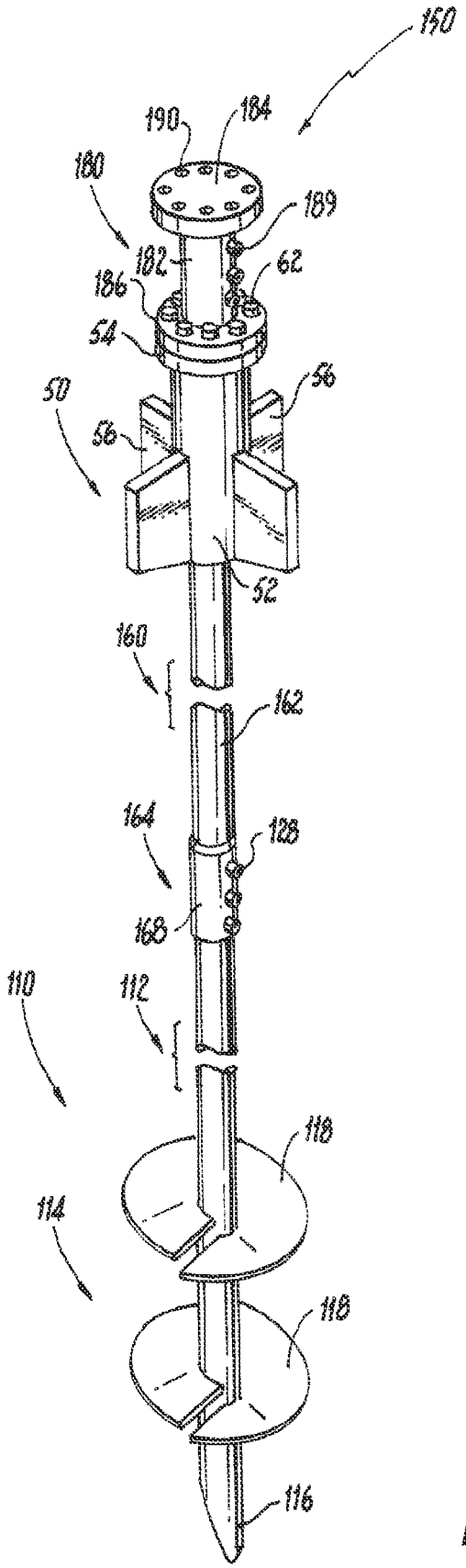
FIG. 17 is a perspective view of another exemplary embodiment of a helical pile assembly according to the present disclosure, illustrating a lead, an extension inserted into a shaft of a support member, and a drive tool adjacent the support member.
Figure 18:
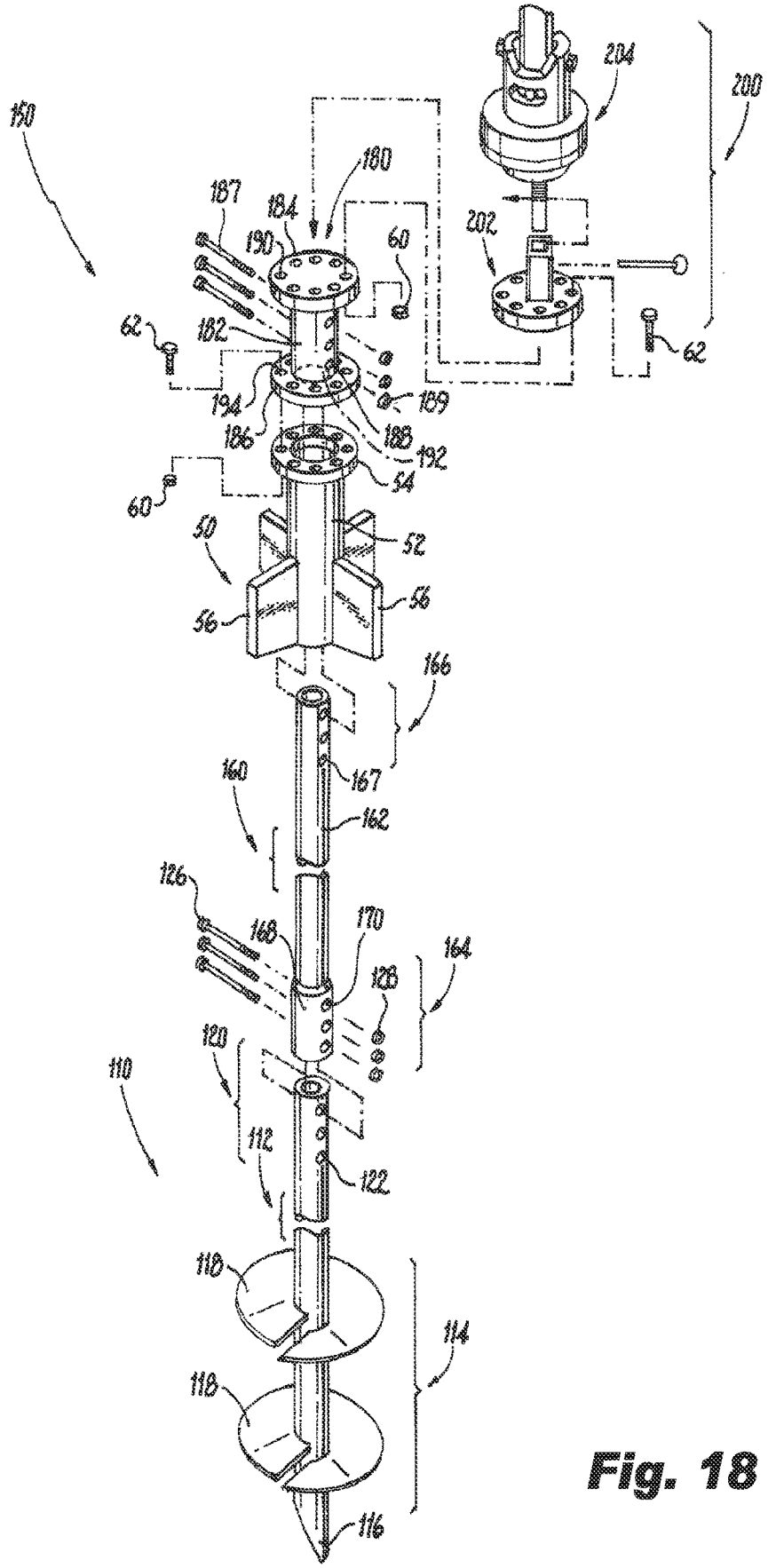
FIG. 18 is an exploded perspective view of the helical pile assembly of FIG. 17.
Figure 19:
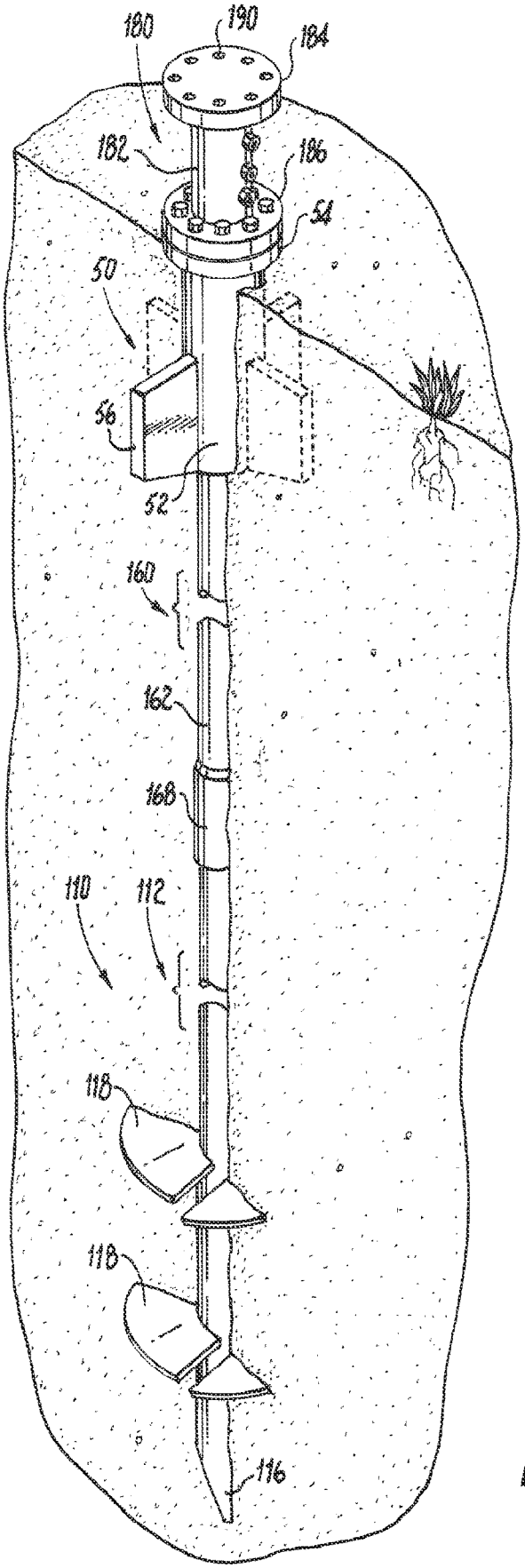
FIG. 19 is a perspective view of the helical pile assembly of FIG. 17, illustrating the lead and extension driven into the soil, the fins of the support member pulled into the soil, and the drive tool attached to the support member.

In the exemplary embodiment of FIGS. 17-19, the extension 160 includes an extension shaft 162 having an extension end portion 164 and an extension head portion 166. In this exemplary embodiment, the extension shaft 162 is preferably circular in cross-section. However, in other exemplary embodiments the extension shaft 162 may have other cross-sectional shapes, such as square, rectangular, pentagonal or hexagonal. The length of the extension shaft 162 may range from, for example, about 3 feet to about 10 feet. The diameter or width of the extension shaft 162 may range from, for example, about 1 inch to about 7 inches. The extension shaft 162 may be fabricated from steel or galvanized steel and may be hollow or solid. For hollow extension shafts 162, the thickness of the wall of the shaft may range from, for example, about 0.2 of an inch to about 0.4 of an inch. It is noted that the dimensions of the extension shaft 162 for a particular installation would depend upon the load the pile 150 is to carry, the soil conditions and the type of equipment used for installation.

The extension end portion 164 has a coupler 168, e.g., a female coupler, configured to receive the lead head portion 120 or an extension head portion 166 of another extension. The coupler 168, here a female coupler, includes one or more connection apertures 170 therethrough, each capable of receiving the bolt 126, as shown in FIG. 18. The one or more connection apertures 170 in the female coupler 168 are configured and positioned to align with the one or more connection apertures 122 in the lead head portion 120. In this configuration, the extension end portion 164 can be secured to the lead head portion 120 using the bolt 126 that is passed through the apertures 170 and 122 and the nut 128 is secured to the bolt.

Continuing to refer to FIGS. 17-19, the drive tool 180 includes a tool shaft 182, an upper flange 184 and a lower flange 186. The tool shaft 182 is between the upper flange 184 and the lower flange 186, as shown. The upper flange 184 and lower flange 186 may be secured to the tool shaft 182 using for example welds, or the tool shaft 182, upper flange 184 and lower flange 186 may be integrally or monolithically formed as a single structure. Preferably, the tool shaft 182 is a hollow shaft with an inner diameter that is larger than an outer diameter (or width) of the extension head portion 166 of the extension shaft 162 so that the tool shaft 182 can receive the extension head portion 166. The tool shaft 182 includes one or more connection apertures 188 therethrough that can be aligned with the one or more connection apertures 167 in the extension head portion 166. The one or more connection apertures 167 are capable of receiving a bolt 187 used to secure the extension shaft 162 to the tool shaft 182 of the drive tool 180 along with nut 189.

The upper flange 184 of the drive tool 180 is provided to mate the drive tool to the drive wrench 202 of the drive system 200. In the exemplary embodiment shown, the upper flange 184 is a flat cylindrical plate having one or more apertures 190 positioned around a perimeter of the plate. The one or more apertures 190 are used to secure the drive tool 180 to the drive wrench 202 using fasteners, such as nuts and bolts. The lower flange 186 is a flat cylindrical plate having a central bore 192 with one or more connection apertures 194 positioned around a perimeter of the plate. The central bore 192 is configured and dimensioned to permit the extension head portion 166 to pass through the lower flange 186 into the tool shaft 182. The one or more connection apertures 194 are positioned to align with the one or more mounting apertures 58 around a perimeter of the flange 54 of the support member 50 so that the lower flange 186 can be secured to the flange 54 using, for example, nuts 60 and bolts 62, seen in FIG. 13. Securing the lower flange 186 to the flange 54 secures the support member 50 to the extension shaft 162 via the drive tool 180.

The installation of the pile 150 in the exemplary embodiment is described with reference to FIGS. 17-19. Initially, the drive head 204 of the drive motor of the drive system 200 is coupled to the lead 110 and activated to rotate the lead shaft 112 driving the lead 110 into the soil. When the lead shaft 112 is driven into the soil so that the lead head portion 120 is just above the soil, the drive head 204 detached from the lead 110. The support member 50 is then positioned onto the extension shaft 162. More specifically, the flange 54 of the support member shaft 52 is moved past the coupler 168 on the extension end portion 164. With the support member 50 positioned onto the extension shaft 162, the extension shaft 162 is coupled to the lead shaft 112. More specifically, the coupler 168 of the extension end portion 164 is positioned onto the lead head portion 120, and the one or more bolts 126 are passed through the one or more connection apertures 135 and 122. The nut 128 is the threaded onto the bolt 126 and tightened to secure the extension 160 to the lead 110. The drive tool 180 is then positioned onto the extension head portion 166 so that the connection apertures 188 in the tool shaft 182 are aligned with the connection apertures 167 in the extension head portion 166 of the extension 160. One or more bolts 187 are passed through the connection apertures 188 and 167 and one or more nuts 189 are used to secure the tool shaft 182 to the extension shaft 162. The drive wrench 202 of the drive system 200 is secured to the upper flange 184 of the drive tool 180 using, for example, bolts and nuts. The drive head 204 is then coupled to the drive wrench 202, as is known, and the drive head is activated to rotate the extension shaft 162 so that the extension 160 and the lead 110 are driven into the soil until the one or more fins 56 of the support member 50 are pulled into the soil, as shown in FIG. 19. It is noted that as the extension shaft 162 rotates, the support member 50 does not rotate due to the independent relationship between the extension shaft 162 and the support member shaft 52 described above. With the fins 56 of the support member 50 below grade, the drive wrench 202 and drive head 204 of the drive system 200 are removed from the drive tool 180. The lower flange 186 of the drive tool 180 is then secured to the flange 54 of the support member 50 using bolts 62 and nuts 60. In this configuration, the support member 50 is now secured to the extension shaft 162 via the drive tool 180.

Additional exemplary embodiments of pile assemblies are shown in FIGS. 20-29. In the exemplary embodiment of FIG. 20, the pile assembly 250 includes a lead 260 and another exemplary embodiment of a support member 320. In the exemplary embodiment of FIG. 20A, the pile assembly 250 includes a support member extension 290 and the support member 320. In the exemplary embodiment of FIG. 20A, the support member extension 290 may be connected to a lead 110, seen in FIG. 18, or the support member extension 290 may be connected to one or more extensions 160, seen in FIG. 18, between the lead 110 and the support member extension 290. The lead 110 and one or more extensions 160 are described in detail hereinabove and for ease of description are not described in detail here.

Figure 20:
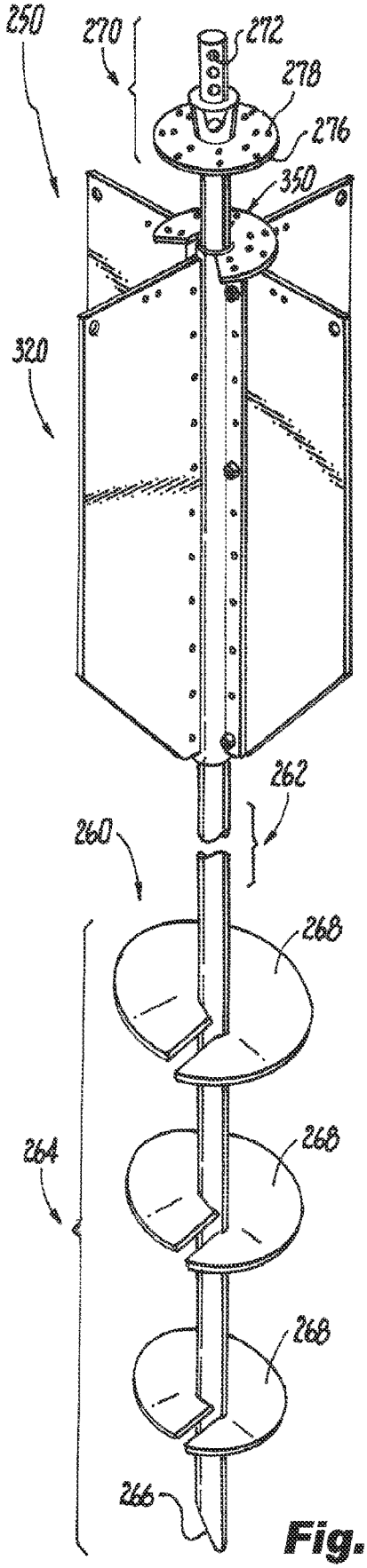
FIG. 20 is a side perspective view of another exemplary embodiment of a helical pile assembly according to the present disclosure, illustrating a lead and another exemplary embodiment of a support member according to the present disclosure.

Referring to FIG. 20, the lead 260 includes a lead shaft 262 that is preferably circular in cross-section. However, in other exemplary embodiments the lead shaft 262 may have other cross-sectional shapes, such as square, rectangular, pentagonal or hexagonal. The length of the lead shaft 262 may range from, for example, about 3 feet to about 10 feet. The diameter or width of the shaft 262 may range from, for example, about 1 inch to about 7 inches. The lead shaft 262 may be fabricated from steel or galvanized steel and may be hollow or solid. For hollow lead shafts 262, the thickness of the wall of the lead shaft 262 may range from, for example, about 0.2 of an inch to about 0.4 of an inch. It is noted, however, that the dimensions of the lead shaft 262 for a particular installation would depend upon the load the pile assembly 250 is to carry, the soil conditions and the type of equipment used for installation.

The lead shaft 262 has an end portion 264 that may include a pointed tip 266 and one or more load bearing helical plates 268 secured thereto that when rotated screw or drive the pile assembly 250 into the soil with minimal disruption to the surrounding soil. The diameter of the helical plates 268 may range from, for example, about 6 inches to about 48 inches. In the event there are multiple helical plates 268 attached to the lead shaft 262, the helical plates 268 may have the same outer diameter, or the helical plates 268 may have different outer diameters that are, for example, in a tapered arrangement. As an example, the tapered arrangement may be such that the smallest outer diameter helical plate 268 is closest to the lead tip 266 and the largest helical plate is at a distance away from the lead tip 266, as shown in FIG. 20. If multiple helical plates 268 are employed, the helical plates on the lead shaft 262 would be spaced apart at a predefined distance that is sufficient to promote individual plate load bearing capacity. In other words, the helical plates 268 are spaced apart such that these helical plates will behave or act as individual load bearing elements without interference or influence from adjacent helical plates 268. To accomplish this independent performance, a helical plate 268 is located at a specific distance from adjacent helical plates 268. Preferably, a helical plate 268 is located a predefined multiple of the diameter of the lower helical plate 268 to an adjacent helical plate above it. For example, a predefined distance between the helical plates 268 may be a multiple, e.g., three times, of the diameter of the lowest helical plate 268. Thus, if the outer diameter of the lowest helical plate 268 is 10 inches, the distance to the next helical plate 268 would be three times that 10 inch diameter. The helical plates 268 may be fabricated from steel or galvanized steel and may be welded to or otherwise attached to the lead shaft 262.

In the exemplary embodiment shown in FIG. 20, the lead shaft 262 also includes a head portion 270 configured to connect to a drive system, e.g., drive system 200. Typically, the lead head portion 270 is connected to the drive system 200 using one or more removable fasteners 384, such as pins seen in FIG. 29, bolts or other removable fasteners. In the embodiment shown, the lead shaft 262 in the lead head portion 270 is configured to couple to a known drive head 380 of the drive system 200. More specifically, the lead head portion 270 includes one or more connection apertures 272 configured and dimensioned to receive the removable fasteners 384, e.g., pins, bolts, etc. The head portion 270 of the lead shaft 262 also includes an attachment member 276 secured to the lead shaft 262. Preferably, the attachment member 276 is positioned on the lead shaft 262 in the lead head portion 270 at a point below the connection apertures 272 and a sufficient distance away from the connection apertures 272 to allow the drive head 380 to receive a portion of the lead shaft 262 in the lead head portion 270. However, the present disclosure contemplates that the attachment member 276 can be positioned at any point along the lead shaft 262 such that the attachment member 276 would be above the highest helical plate 268 when the support member 320 is coupled to the lead shaft 262, as described below. The attachment member 276 may be fabricated from steel or galvanized steel and includes a central opening through which the lead shaft 262 extends. In the embodiment shown, the attachment member 276 is a flat cylindrical plate that is transversely disposed relative to the lead shaft 262. According to one exemplary embodiment, the attachment member 276 may be integrally or monolithically formed with the lead shaft 262. According to another exemplary embodiment, the attachment member 276 may be a separate component that is attached to the lead shaft 262 by welds, fasteners, and/or adhesives. The attachment member 276 includes a plurality of mounting apertures 278 extending therethrough. The mounting apertures 278 can be used to secure the lead shaft 262 to the support member 320, as will be described in more detail below.

Figure 20A:
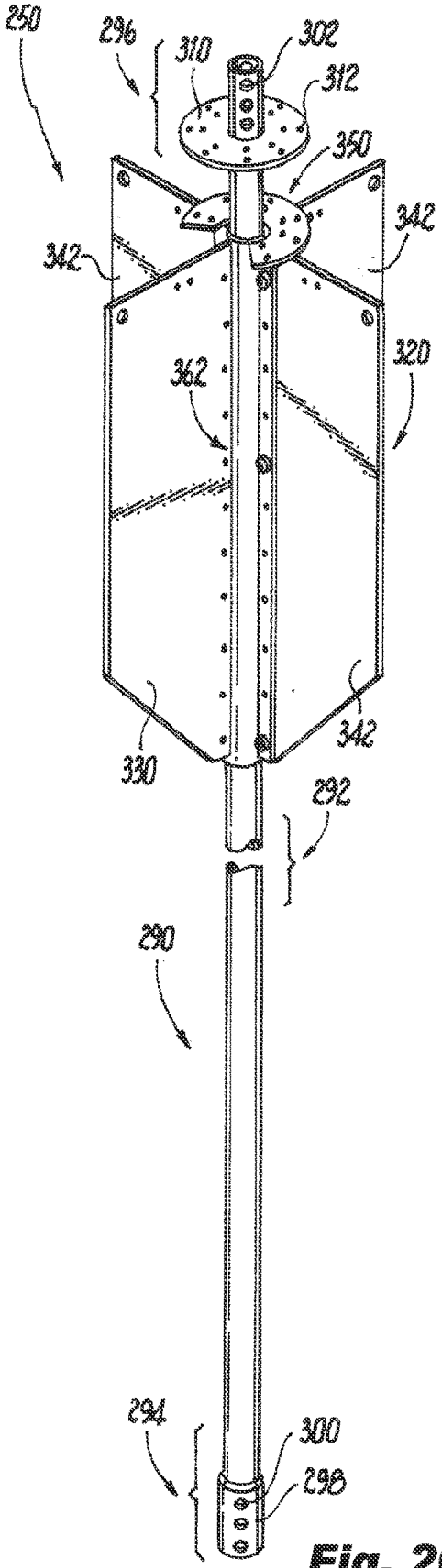
FIG. 20A is a side perspective view of the support member shown in FIG. 20 attached to an extension.
Figure 21:
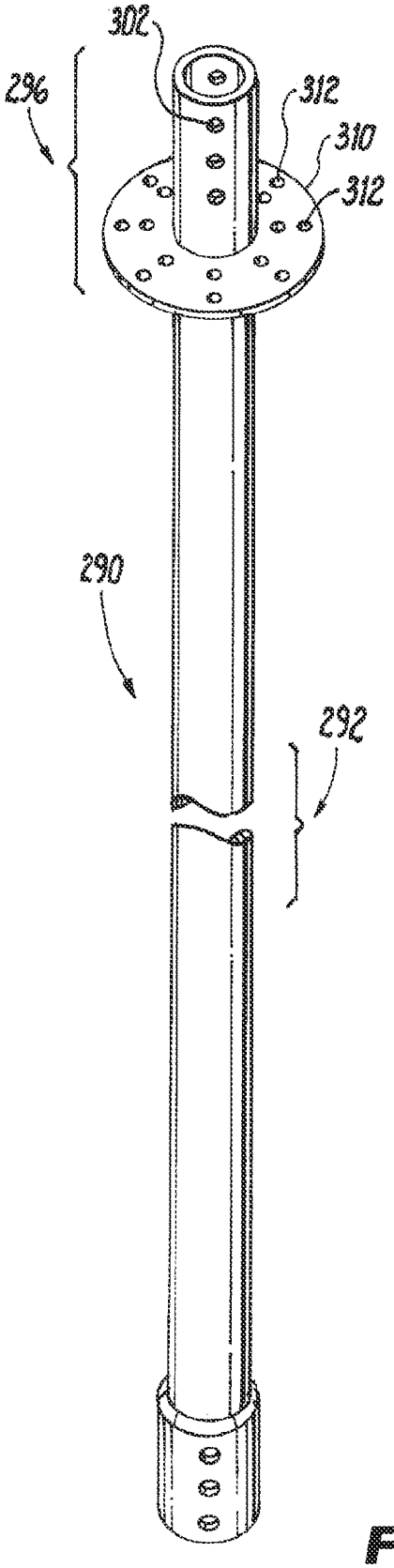
FIG. 21 is a side perspective view of the extension shown in FIG. 20A, illustrating an attachment member secured to a shaft of the extension.
Figure 22:
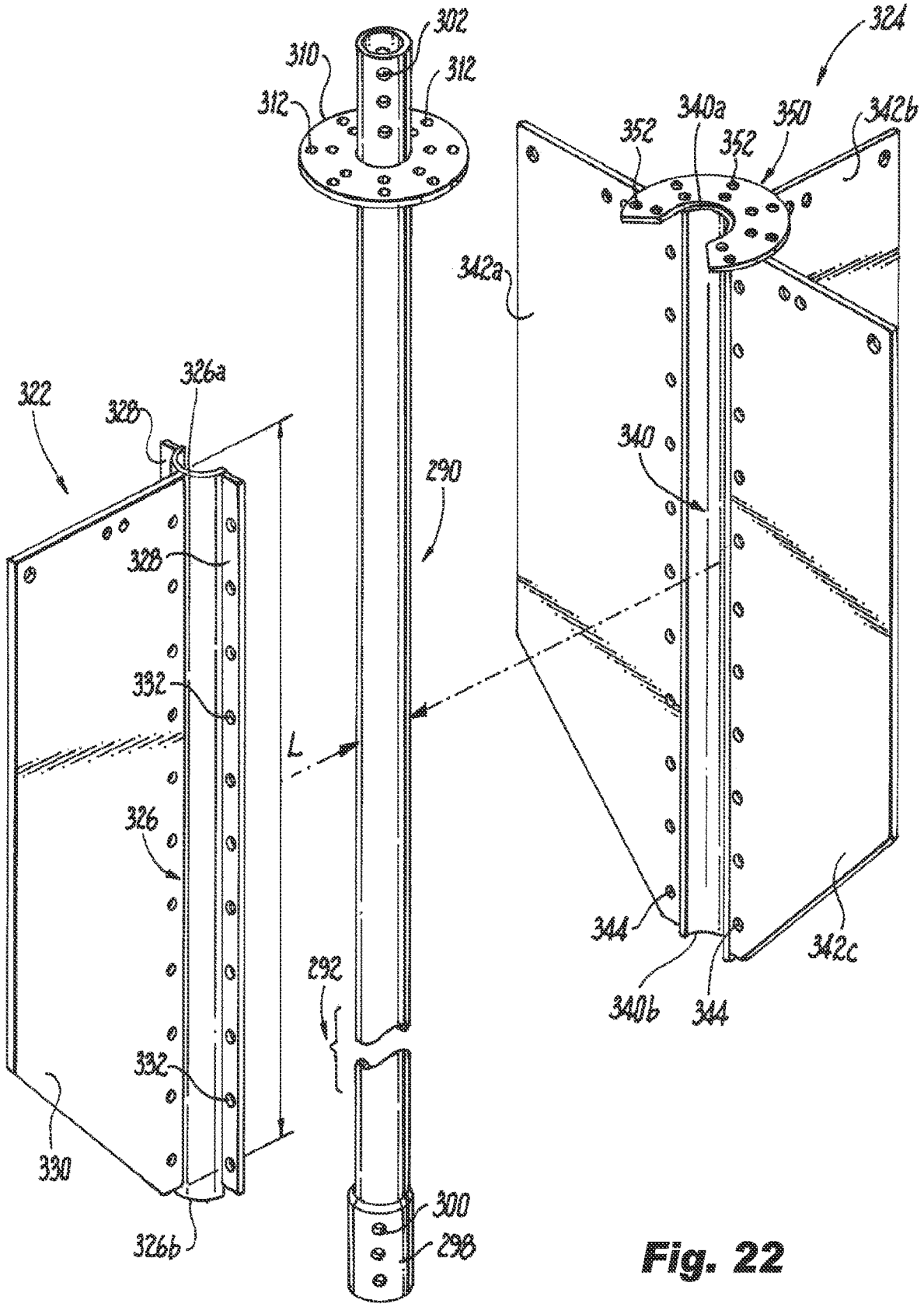
FIG. 22 is an exploded perspective view of the helical pile assembly of FIG. 20A illustrating the support member separated from the extension.

Referring to FIGS. 20A, 21 and 22, the support member extension 290 includes an extension shaft 292 having an extension end portion 294 and an extension head portion 296. In this exemplary embodiment, the extension shaft 292 is preferably circular in cross-section. However, in other exemplary embodiments the extension shaft 292 may have other cross-sectional shapes, such as square, rectangular, pentagonal or hexagonal. The length of the extension shaft 292 may range from, for example, about 3 feet to about 10 feet. The diameter or width of the extension shaft 292 may range from, for example, about 1 inch to about 7 inches. The extension shaft 292 may be fabricated from steel or galvanized steel and may be hollow or solid. For hollow extension shafts 292, the thickness of the wall of the shaft may range from, for example, about 0.2 of an inch to about 0.4 of an inch. It is noted, however, that the dimensions of the extension shaft 292 for a particular installation would depend upon the load the pile assembly 250 is to carry, the soil conditions and the type of equipment used for installation.

Figure 27:
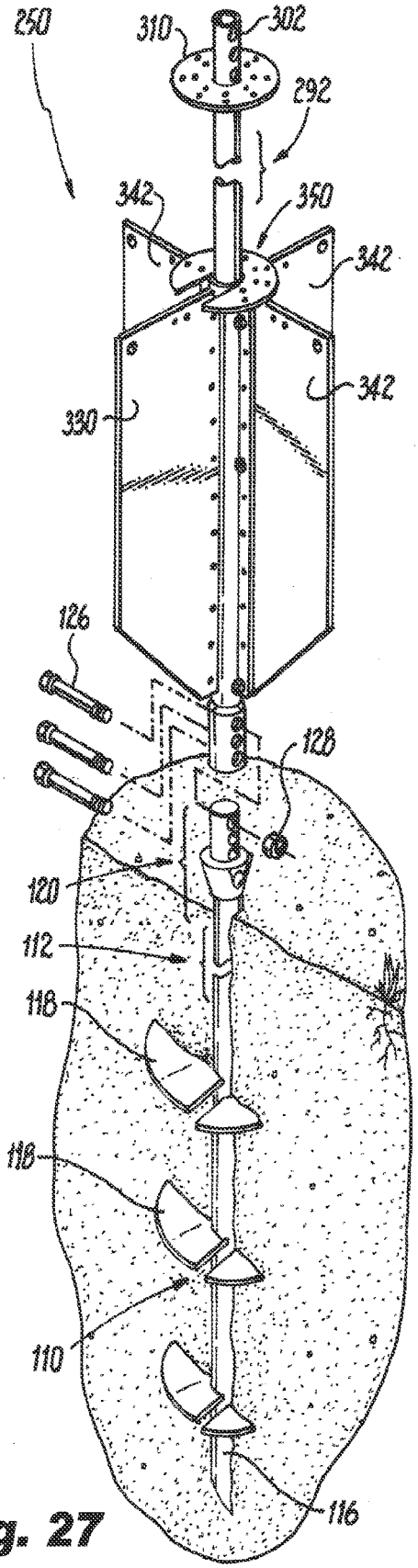
FIG. 27 is a side perspective view of a helical pile assembly according to the present disclosure, illustrating a lead driven into the soil and the support member and extension of FIG. 20A positioned for connection to the lead.

Continuing with FIGS. 20A, 21 and 22, the extension end portion 294 includes a hub or coupler 298, e.g., a female coupler, that has a larger inner diameter than an outer diameter of the head portion 120 of a lead shaft 112 of a lead 110, seen in FIG. 18. In instances where one or more extensions 160 are positioned between the support member extension 290 and a lead 110, the extension shaft 292 would include a hub or coupler 298 with a larger inner diameter than an outer diameter of an extension shaft 162. Thus, the female coupler 298 is configured and dimensioned to receive the head portion 120 of the lead shaft 112 of the lead 110, or the female coupler 296 is configured and dimensioned to receive the head portion 166 of the extension shaft 160. The coupler 298 includes one or more connection apertures 300 therethrough that are capable of receiving a removable fastener, such as the bolt 126 seen in FIGS. 18 and 27. The one or more connection apertures 300 in the female coupler 298 are configured and positioned to align with the one or more connection apertures 122 in the head portion 120 of the lead shaft 112 of the lead 110, or with the one or more connection apertures 167 in the head portion 166 of the extension shaft 162 of the extension 160. In this configuration, the extension end portion 294 can be secured to the head portion 120 of the lead shaft 112, or the head portion 166 of the extension shaft 162 using a bolt 126 that is passed through the connection apertures 300 and 122, or the connection apertures 300 and 167, and the nut 128, seen in FIGS. 18 and 27, is threaded onto the bolt 126 and tightened.

Figure 29:
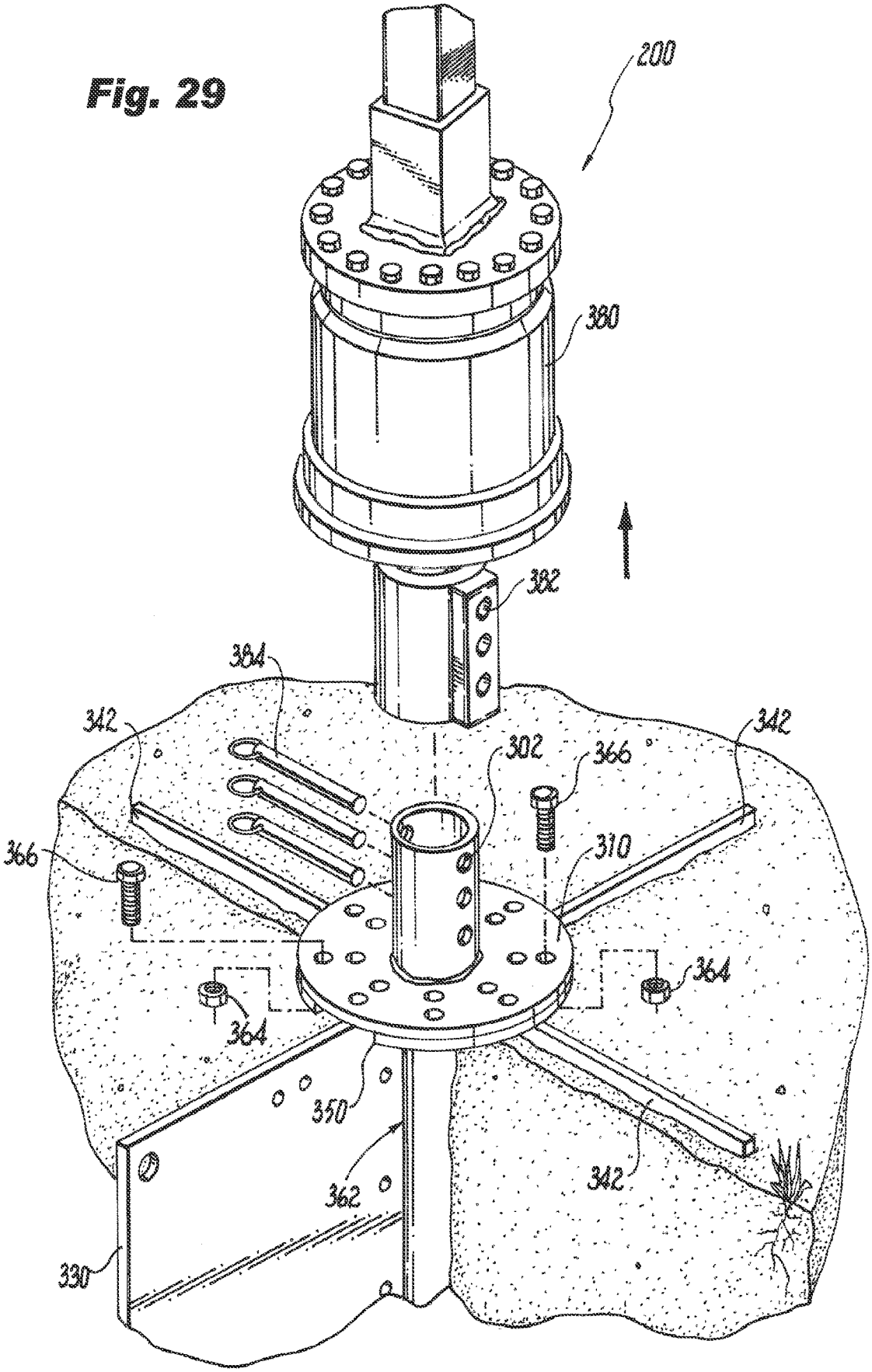
FIG. 29 is an enlarged top perspective view of a portion of the helical pile assembly of FIG. 28 with the helical pile assembly is driven into the soil and prior to an attachment plate of the extension being secured to an attachment member of the support member.

The portion of the extension shaft 292 in the extension head portion 296 includes one or more connection apertures 302 therethrough that are capable of receiving a removable fastener 384, e.g., pins, bolts or other similarly releasable fastener, seen in FIG. 29. The portion of the extension shaft 292 in the extension head portion 296 is configured to couple to a known drive head 380 of the drive system 200, seen in FIG. 29. The drive head 380 is configured and dimensioned to be releasably coupled to the extension head portion 296 of the extension shaft 292. The one or more connection apertures 302 in the extension head portion 296 are configured and positioned to align with one or more connection apertures 382 in the drive head 380 such that the extension head portion 296 can be releasably coupled with the drive head 380 using the releasable fastener 384, e.g., pin, a bolt or other releasable fastener.

Figure 25:
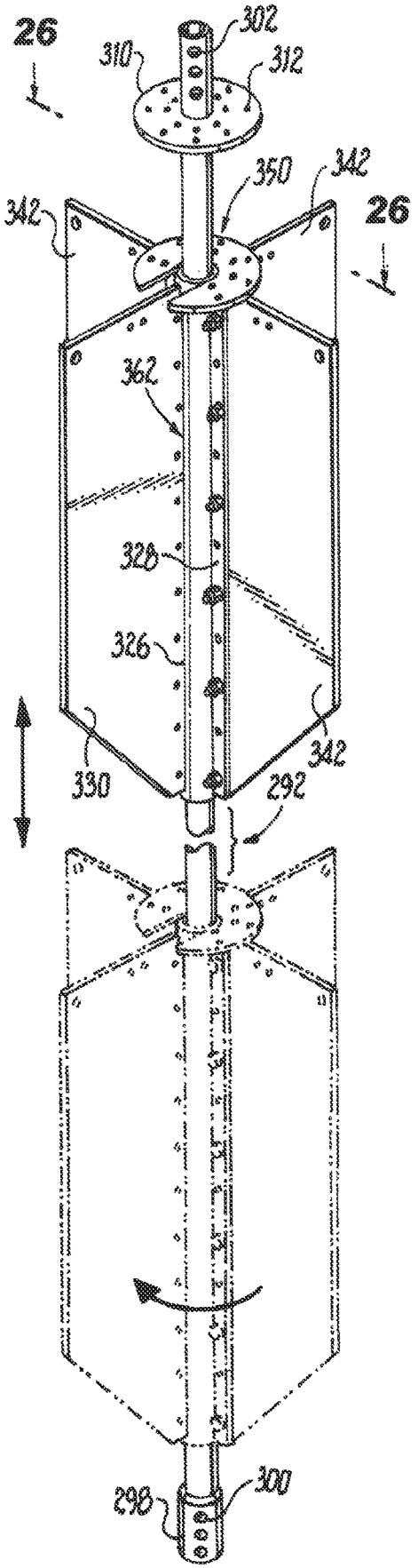
FIG. 25 is a top perspective view of the helical pile assembly of FIG. 20A, illustrating the support member being movable along the shaft of the extension.

Referring now to FIGS. 21, 22 and 25, the extension head portion 296 of the extension 290 further includes an attachment member 310 secured to the extension shaft 292. Preferably, the attachment member 310 is positioned on the extension shaft 292 in the extension head portion 296 at a point below the connection apertures 302 and a sufficient distance away from the connection apertures 302 to allow the drive head 380 to receive the portion of the extension shaft 292 in the extension head portion 296. However, the present disclosure contemplates that the attachment member 310 can be positioned at any point along the extension shaft 292 such that the attachment member 310 would be above the support member 320 when the support member is mated to the extension shaft 292, as described below. The attachment member 310 may be fabricated from steel or galvanized steel and includes a central opening through which the extension shaft 292 extends. In the embodiment shown, the attachment member 310 is a flat cylindrical plate that is transversely disposed relative to the extension shaft 292. According to one exemplary embodiment, the attachment member 310 may be integrally or monolithically formed with the extension shaft 292. According to another exemplary embodiment, the attachment member 310 may be a separate component that is attached to the extension shaft 292 by welds, fasteners, and/or adhesives. The attachment member 310 includes a plurality of mounting apertures 312 extending therethrough. The mounting apertures 312 can be used to secure the extension shaft 292 to the support member 320, as will be described in more detail below.

Referring now to FIGS. 22-26, an exemplary embodiment of the support member 320 according to the present disclosure is shown. The support member 320 includes a first support member segment 322 and a second support member segment 324. The first support member segment 322 and the second support member segment 324 may be fabricated from steel or galvanized steel. The first support member segment 322 includes a first hub body 326, a pair of flanges 328 and a fin 330. The first hub body 326 is an elongated member having a shape configured to conform to the shape of the support member extension shaft 292 or the lead shaft 262. In the embodiment shown, the support member extension shaft 292 has a circular cross-section and the first hub body 326 is an arcuate shaped member where the arcuate shape conforms to the shape of a portion of the circular support member extension shaft 292. The first hub body 326 includes a top end 326*a* and a bottom end 326*b*. The flanges 328 are attached to and extend from the first hub body 326 at or near the endpoints of the first hub body so that the flanges are substantially perpendicular to the endpoints of the first hub body 326. Preferably, the flanges 328 are attached to the first hub body 326 so that the flanges 328 and the endpoints of the first hub body 326 are substantially aligned in the same plane. Each flange 328 includes a plurality of mounting holes 332 used when attaching the first support member segment 322 to the second support member segment 324. The fin 330 is attached to and extends from the first hub body 326 as shown in FIG. 22. The fin 330 provides resistance to lateral and torsional loads on the piles 250. In the embodiment shown in FIG. 22, the fin 330 is attached to and extends from the first hub body 326 at or near the apex of the arcuate shape of the first hub body 326. The fin 330 may be integrally or monolithically formed into the first hub body 326 or the fin 330 may be secured to the first hub body 326 using welds, fasteners or adhesives.

Continuing to refer to FIGS. 20A and 22, the second support member segment 324 includes a second hub body 340 and one or more fins 342. In the exemplary embodiment shown in FIG. 22, there are three fins 342*a*, 342*b* and 342*c*. The second hub body 340 is similar to the first hub body 326 in that the second hub body 340 is an elongated member having a shape configured to conform to the shape of the support member extension shaft 292 or the lead shaft 262. In the embodiment shown, the support member extension shaft 292 has a circular cross-section and the second hub body 340 is an arcuate shaped member where the arcuate shape conforms to the shape of the circular support member extension shaft 292. The fins 342*a* and 342*c* are attached to and extend from the second hub body 340 at or near the endpoints of the second hub body so that the fins are substantially perpendicular to the endpoints of the second hub body 340. The fins 342 provide resistance to lateral and torsional loads on the piles 250. Preferably, the fins 342*a* and 342*c* are attached to the second hub body 340 so that the fins 342*a* and 342*c* and the endpoints of the second hub body 340 are substantially aligned in the same plane. Each fin 342*a* and 342*c* includes a plurality of mounting holes 344 used when attaching the first support member segment 322 to the second support member segment 324. The fin 342*b* is attached to and extends from the second hub body 340 as shown in FIG. 22. In the embodiment shown in FIG. 22, the fin 342*b* is attached to and extends from the second hub body 340 at or near the apex of the arcuate shape of the second hub body 340. The fins 342 may be integrally or monolithically formed into the second hub body 340, or the fins 342 may be secured to the second hub body 340 using welds, fasteners or adhesives.

The second hub body 340 includes a top end 340*a* and a bottom end 340*b*. An attachment member 350 is secured to the top end 340*a* of the second hub body 340. In one embodiment, the attachment member 350 may be secured to the top end 340*a* of the second hub body 340 using welds, fasteners or adhesives. In another embodiment, the attachment member 350 may be integrally or monolithically formed into the top end 340*a* of the second hub body 340. The attachment member 350 may be fabricated from steel or galvanized steel and includes an opening 354, e.g., a slot, configured to receive the support member extension shaft 292 or a lead shaft 112 when the first support member segment 322 is mated to the second support member segment 324. In the embodiment shown, the attachment member 350 is a slotted, flat cylindrical plate that is secured to the top end 340*a* of the second hub body 340 so that the slotted, flat cylindrical plate is transversely disposed relative to the second hub body 340. The width of the slot 354 should be sufficient for the slotted plate 350 to receive the extension shaft 292 or a lead shaft 112 so that the extension shaft 292 (or the lead shaft 262) can extend through the slotted plate 350 and freely move relative to the extension shaft 292 (or the lead shaft 262). In another embodiment, the mouth of the slotted plate 350 may have bevelled edges, such as shown for example in FIGS. 22 and 23, that act as a lead-in to facilitate easy mating or coupling of the second support member segment 324 to the first support member segment 322 around the extension shaft 292 or a lead shaft 262. The attachment member 350 includes a plurality of mounting apertures 352 extending therethrough. The mounting apertures 352 can be used to secure the support member 320 to the support member extension shaft 292 (or the lead shaft 262), as will be described in more detail below.

Continuing to refer to FIGS. 22-26, the first and second support member segments 322 and 324 are configured to mate to one another to form the support member 320 positioned around the support member extension shaft 292 (or the lead shaft 262). To secure the first support member segment 322 to the second support member segment 324, bolts 358 are passed through the mounting holes 344 in the fins 342*a* and 342*c* of the second support member segment 324 and through the mounting holes 332 in the flanges 328 of the first support member segment 322. A nut 360 is then threaded onto the bolt 358 and tightened. When the first and second support member segments 322 and 324 are secured together, the first hub body 326 and the second hub body 340 form a support shaft 362 with an opening 356, seen in FIG. 23, in which the extension shaft 292 (or the lead shaft 262) can fit. The opening 356 is configured so that the support member 320 can freely and independently move relative to the extension shaft 292 (or the lead shaft 262), as shown in FIG. 25. More specifically, the opening 356 has an inner diameter "D," seen in FIG. 24, that is larger than an outer diameter (or width) of the extension shaft 292 (or the lead shaft 262) so that the support shaft 362 can receive the extension shaft 292 (or the lead shaft 262) and move independent of the extension shaft 292 (or the lead shaft 262). For example, the support shaft 362 can rotate and/or move longitudinally independent of the extension shaft 292 (or the lead shaft 262), as shown in FIG. 25. As a non-limiting example, the inner diameter "D" of the support shaft 362 can be in the range of, for example, about 1 inch and about 8 inches. By having the support shaft 362 independent of the extension shaft 292 (or the lead shaft 262), when the extension shaft 292 is rotated to screw in the lead shaft 112 into the soil, the extension shaft 292 can freely rotate relative to the support shaft 362 so that the fins 330 and 342 do not rotate so as not to disturb the soil. It is further noted that the inner diameter "D" of the support shaft 362 may be smaller than the outer diameter of the female coupler 298 so that the support member 320 can rest on the female coupler 298 at least when the extension shaft 292 is first connected to a lead shaft 112 or an extension shaft 162.

Figure 26:
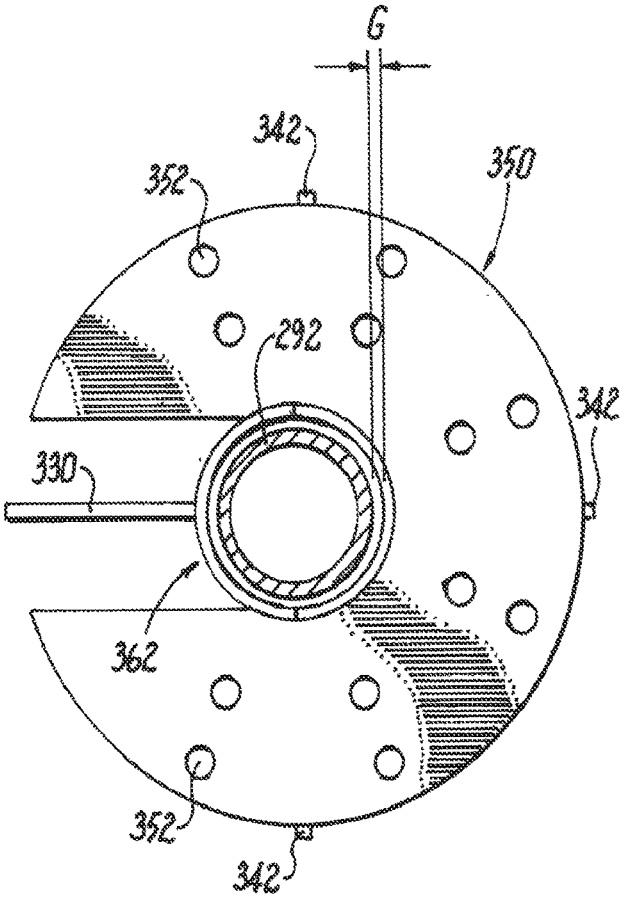
FIG. 26 is top plan view of the support member of FIG. 25 taken from line 26-26.

Referring again to FIG. 22, the length "L" of the support shaft 362 may range from, for example, about 1 foot to about 5 feet. As noted above, the diameter or width of the support shaft 362 is greater than a diameter or width of the extension shaft 292 (or the lead shaft 2626) so that there is a gap "G" between the support shaft 362 and the extension shaft 292, as shown in FIG. 26. In the exemplary embodiment of FIGS. 25 and 26, the gap "G" is sufficient to permit the support shaft 362 to be free floating relative to the extension shaft 292 (or the lead shaft 262). As described above, the support shaft 362 may be fabricated from steel or galvanized steel. Further, the thickness of the wall of the support shaft 362 may be in the range of, for example, about 0.2 of an inch to about 0.5 of an inch. However, it is noted that the dimensions of the support shaft 362 for a particular installation would depend upon the lateral and torsional loads the pile is to withstand, the soil conditions and the type of equipment used for installation. Also, it is contemplated that the support member 320 can be attached to the lead shaft 262 of the lead 260, as shown in FIG. 20.

Figure 28:
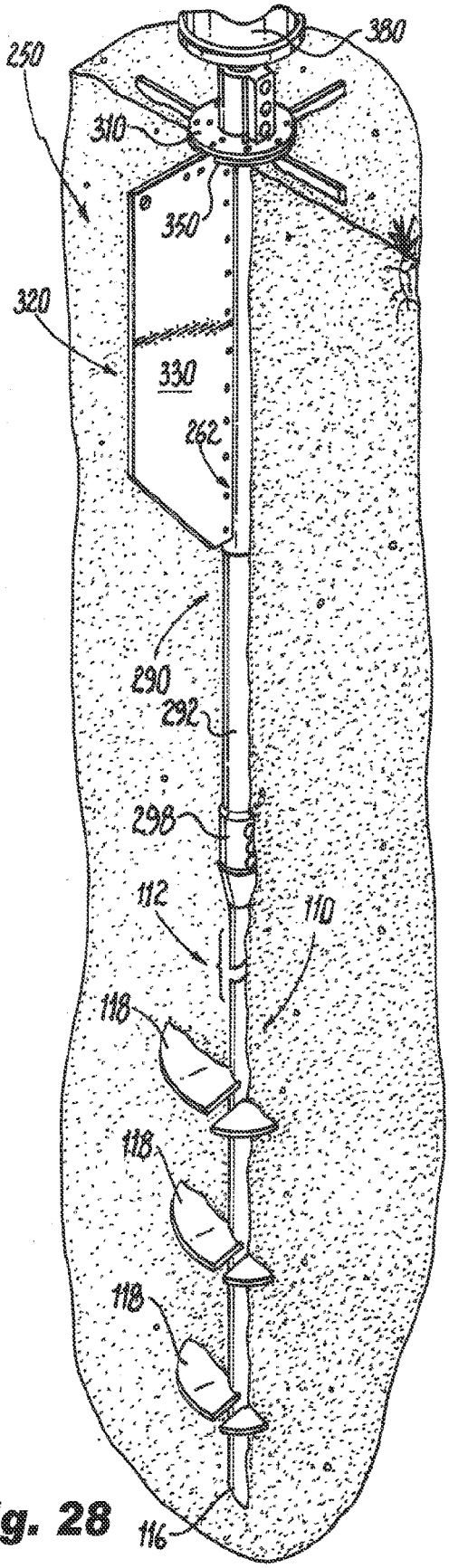
FIG. 28 is a side perspective view of the helical pile assembly of FIG. 27 with the extension and support member connected to the lead and driven into the soil.

With reference to FIGS. 25, 28 and 29, as mentioned above, the attachment member 310 of the support member extension 290 includes a plurality of mounting apertures 312, and the attachment member 350 of the support member 320 includes a plurality of mounting apertures 352. The plurality of mounting apertures 312 and 352 can be used to attach the support member 320 to the extension shaft 292 (or the lead shaft 262), such as for example after the extension shaft 292 (or the lead shaft 262) is at least partially driven into the soil. More specifically, one or more mounting apertures 312 of the attachment member 310 can be aligned with one or more mounting apertures 352 of the attachment member 350 so that the attachment member 350 can be secured to the attachment member 310 using for example nuts 364 and bolts 366, seen in FIG. 29.

Figure 23:
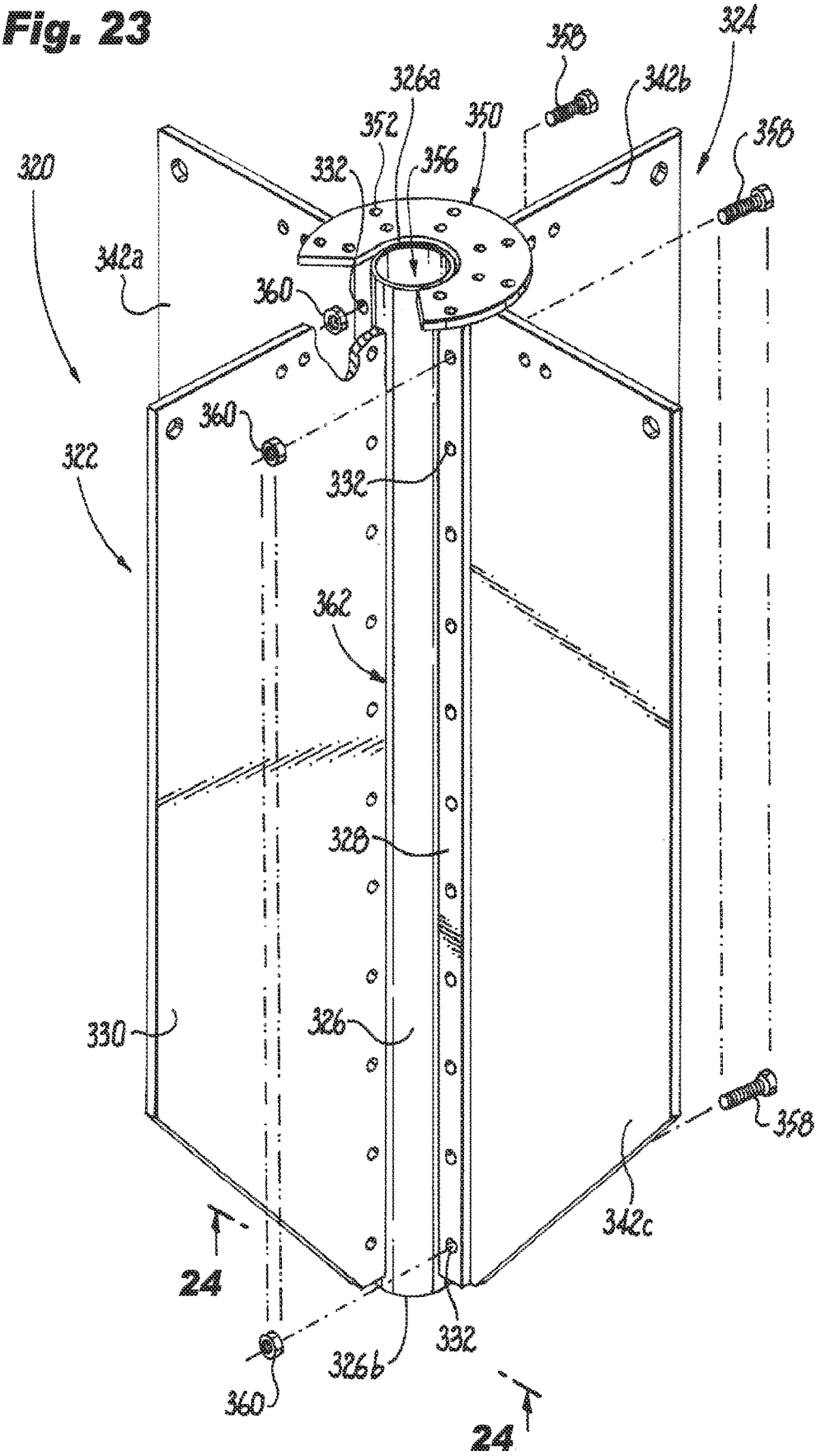
FIG. 23 is a top perspective view of the support member of FIG. 20A.
Figure 24:
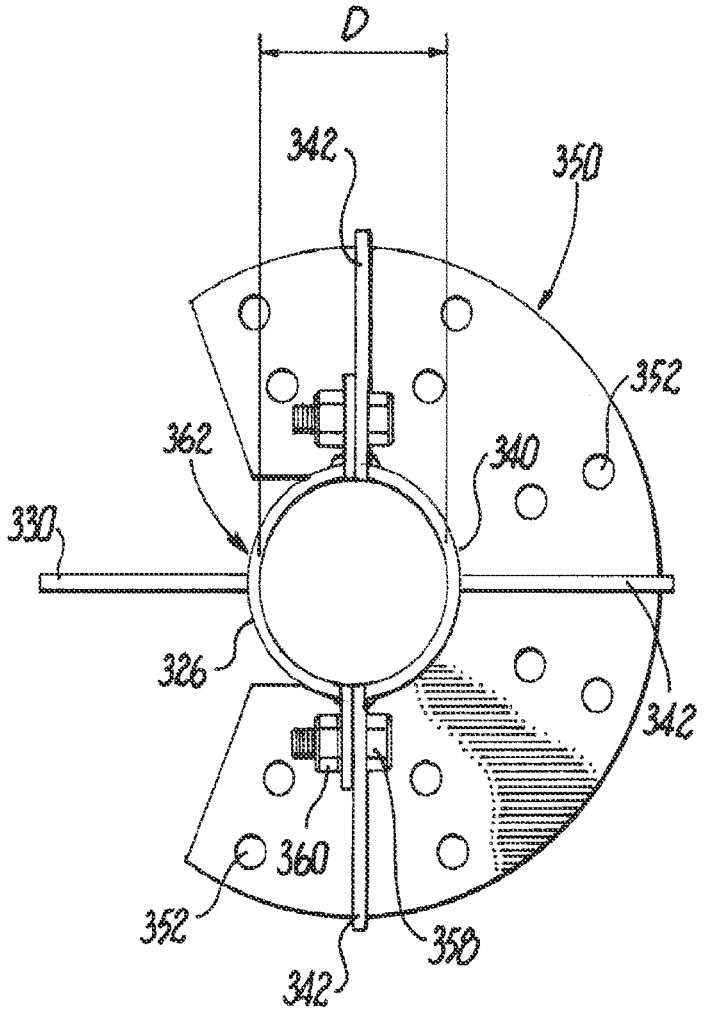
FIG. 24 is a bottom plan view of the support member of FIG. 23 taken from line 24-24.

In the exemplary embodiment of FIGS. 22 and 23, when the first support member segment 322 is secured to the second support member segment 324, the fins 330 and 342 are spaced around the perimeter of the support shaft 362. The fin 330 is positioned on the first hub body 326 of the support shaft 362 so that a bottom edge of the fin 330 is at or near the bottom end 326*b* of the first hub body 326. Similarly, the fins 342 are positioned on the second hub body 340 so that a bottom edge of the fins 342 are at or near the bottom end 340*b* of the first hub body 340. However, the fins 330 and 340 can be positioned at any location along the support shaft 362. In the exemplary embodiment shown in FIGS. 22 and 23, there are four fins spaced apart at 90-degree intervals around the support shaft 362. However, there may be more than four fins, or less than four fins spaced around the perimeter of the support shaft 362. In the embodiment shown, each fin 330 and 342 has a substantially rectangular shape with at least a portion the bottom edge of each fin preferably tapered. The dimensions of the rectangular shaped fins 330 and 342 may be in the range of, for example, about 6 inches by about 24 inches. However, the present disclosure contemplates other shapes for the fins, such as square shaped fins. Further, the dimensions of each fin 330 and 342 for a particular installation would depend upon the lateral and torsional loads the pile is to withstand, the soil conditions and the type of equipment used for installation.

Referring now to FIGS. 25-29, the installation of a lead 110, a support member extension 290, and a support member 320 into the soil will be described. Initially, the drive head 380 of the drive system 200 is coupled to the lead 110 and activated to rotate the lead shaft 112 driving the lead 110 into the soil. When the lead shaft 112 is driven into the soil so that the lead head portion 120 is just above the soil, the drive head 380 is detached from the lead 110. The support member 320 is then positioned onto the extension shaft 292 of the support member extension 290. With the support member 320 positioned onto the extension shaft 292, the extension shaft 292 is coupled to the lead shaft 112. More specifically, the coupler 298 of the extension end portion 294 is positioned onto the portion of the extension shaft 112 in the lead head portion 120, and the one or more bolts 126 are passed through the one or more connection apertures 300 and 122. The nut 128 is the threaded onto the bolt 126 and tightened to secure the extension shaft 292 to the lead shaft 112. The drive head 380 is coupled with the extension head portion 296 of the extension shaft 292, as described above, and the drive head 380 is activated to rotate the extension shaft 292 so that the support member extension 290 and the lead 110 are driven into the soil until the fins 330 and 342 of the support member 320 are pulled into the soil, as shown in FIGS. 27 and 28. It is noted that as the extension shaft 292 rotates, the support member 320 does not rotate due to the independent relationship between the extension shaft 292 and the support shaft 362 described above. With the fins 330 and 342 of the support member 320 substantially below grade, the drive head 380 of the drive system 200 is removed from the extension head portion 296 of the extension shaft 292, as shown in FIG. 29. The attachment member 310 is then secured to the attachment member 350 using bolts 366 and nuts 364. In this configuration, the support member 320 is now secured to the extension shaft 292 such that the support member 320 is no longer independent of the extension shaft 292. It is noted that the drive head 380 is preferably removed from the extension head portion 296 prior to the attachment member 350 reaching the ground to allow for the nuts 364 to be easily inserted onto the bolts 366.

The support members described herein effectively provide lateral and torsional resistance to minimize and possibly prevent lateral and torsional movement of the lead or extension shafts in the soil. Utilizing the support members with helical piles as described herein, provides a more stabilized platform for supporting certain structures in certain soil conditions. The particular configuration of the support members as well as the diameters and/or shape of the openings in the center portions thereof for receiving the shafts, may depend upon the particular piles being utilized which will generally depend on the load the piles are to bear, and the soil conditions. Accordingly, it will be understood that various modifications can be made to the embodiments of the present disclosure herein without departing from the spirit and scope thereof. Therefore, the above description should not be construed as limiting the disclosure, but merely as embodiments thereof. Those skilled in the art will envision other modifications within the scope and spirit of the disclosure as defined by the claims appended hereto.

What is claimed is:

1. A helical pile assembly comprising:

a lead including:

a lead shaft having a head portion and an end portion;

an attachment member secured to the head portion of the lead shaft, the attachment member includes a plurality of mounting apertures around a perimeter thereof; and at least one helical plate secured to the end portion of the lead shaft; and a support member positioned on the lead shaft between the attachment member and the at least one helical plate, the support member including:

a hollow shaft configured to receive the lead shaft such that the lead shaft is movable independent of the hollow shaft;

a support member flange at one end of the hollow shaft, the support member flange includes a plurality of mounting apertures around a perimeter of the support member flange such that the plurality of support member flange mounting apertures are configured to align with the attachment member mounting apertures when the support member flange is positioned to connect to the attachment member using nuts and headed bolts; and a plurality of fins positioned around a perimeter of the hollow shaft and extending away from the hollow shaft.

2. The helical pile assembly according to claim 1, wherein the attachment member comprises a plate.

3. The helical pile assembly according to claim 1, wherein the lead shaft is rotatable independent of the hollow shaft.

4. The helical pile lead according to claim 1, wherein the hollow shaft has a circular cross-section.

5. The helical pile lead according to claim 1, wherein each of the plurality of fins comprises a plate secured to the hollow shaft.

6. The helical pile lead according to claim 1, wherein each of the plurality of fins has a flat top edge and a flat bottom edge.

7. The helical pile lead according to claim 1, wherein each of the plurality of fins has a flat top edge and at least a portion of a bottom edge is tapered.

8. A helical pile assembly comprising:

a lead including:

a lead shaft having a head portion and an end portion;

at least one helical plate secured to the end portion of the lead shaft;

an extension including:

an extension shaft having a head portion and an end portion, the end portion of the extension shaft being configured to couple to the head portion of the lead shaft;

an attachment member secured to the head portion of the extension shaft, the attachment member includes a plurality of mounting apertures around a perimeter thereof;

a support member positioned on the extension shaft between the attachment member and the end portion of the extension shaft, the support member including:

a hollow shaft configured to receive the extension shaft such that the hollow shaft is movable independent of the extension shaft;

a support member flange at one end of the hollow shaft, the support member flange includes a plurality of mounting apertures around a perimeter thereof such that the plurality of support member flange mounting apertures are configured to align with the attachment member mounting apertures when the support member flange is positioned to connect to the attachment member using nuts and headed bolts; and a plurality of fins positioned around a perimeter of the hollow shaft and extending away from the hollow shaft.

9. The helical pile assembly according to claim 8, wherein the attachment member comprises a plate.

10. The helical pile assembly according to claim 8, wherein the extension shaft is rotatable independent of the hollow shaft.

11. The helical pile lead according to claim 8, wherein the hollow shaft has a circular cross-section.

12. The helical pile lead according to claim 8, wherein each of the plurality of fins comprises a plate secured to the hollow shaft.

13. The helical pile lead according to claim 8, wherein each of the plurality of fins has a flat top edge and a flat bottom edge.

14. The helical pile lead according to claim 8, wherein each of the plurality of fins has a flat top edge and at least a portion of a bottom edge is tapered.

15. A helical pile assembly comprising:

a lead including:

a lead shaft having a head portion and an end portion; and at least one helical plate secured to the end portion of the lead shaft;

an extension including:

an extension shaft having a head portion and an end portion, the end portion of the extension shaft being configured to couple to the head portion of the lead shaft; and a first attachment member secured to the head portion of the extension shaft, the first attachment member includes one or more mounting apertures; and a support member positioned on the extension shaft between the first attachment member and the end portion of the extension shaft, the support member including:

a first support member segment removably mated with a second support member segment to form a hollow shaft configured to receive the extension shaft so that the hollow shaft of the support member is movable independent of the extension shaft, the first support member segment having at least one first fin extending away from the hollow shaft, the second support member segment having a top end, a bottom end, and at least one second fin extending away from the hollow shaft, the top end of the second support member segment includes a second attachment member transversely disposed relative to the hollow shaft, the second attachment member includes one or more mounting apertures that are configured to align with the one or more mounting apertures of the first attachment member when the second attachment member is positioned to connect to the first attachment member using nuts and headed bolts.

16. The helical pile assembly according to claim 15, wherein the first attachment member has a central opening, and wherein the first attachment member is transversely disposed relative to the head portion of the extension shaft with the extension shaft extending through the central opening in the first attachment member.

17. The helical pile assembly according to claim 15, wherein the second attachment member is configured to receive the extension shaft when the first support member segment and the second support member segment are mated.

* * * * *